US007835666B2

(12) United States Patent
Kim et al.

(10) Patent No.: US 7,835,666 B2
(45) Date of Patent: Nov. 16, 2010

(54) IMAGE FORMING APPARATUS AND POWER TRANSMISSION UNIT THEREOF

(75) Inventors: Se-min Kim, Suwon-si (KR); Byung-sun Ahn, Suwon-si (KR); Byeong-hwa Ahn, Seongnam-si (KR); Gi-cheol Jeong, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 255 days.

(21) Appl. No.: 11/944,544

(22) Filed: Nov. 23, 2007

(65) Prior Publication Data

US 2008/0118271 A1 May 22, 2008

(30) Foreign Application Priority Data

Nov. 22, 2006 (KR) ..... 10-2006-0116100

(51) Int. Cl.
*G03G 15/04* (2006.01)

(52) U.S. Cl. ..... 399/119

(58) Field of Classification Search ..... 399/110, 399/111, 119, 120, 222, 223
See application file for complete search history.

(56) References Cited

U.S. PATENT DOCUMENTS 6,768,890 B2 * 7/2004 Cho et al. ..... 399/120 X
7,130,562 B2 * 10/2006 Foster et al. ..... 399/112
7,181,154 B2 * 2/2007 Yamada ..... 399/119
2006/0239716 A1 * 10/2006 Kim et al. ..... 399/223

FOREIGN PATENT DOCUMENTS

| | | |
|---|---|---|
| JP | 3-137659 | 6/1991 |
| JP | 5-61281 | 3/1993 |
| KR | 2004-61061 | 7/2004 |
| KR | 2004-68002 | 7/2004 |

* cited by examiner

*Primary Examiner*—Sandra L Brase
(74) *Attorney, Agent, or Firm*—Staas & Halsey LLP

(57) ABSTRACT

An image forming apparatus including: a main body including a manipulating unit which manipulates the power transmission unit, a driving component having a driving assembling member which is disposed in a direction of a rotational driving axial line; a developing device which has a driven assembling member capable of being engaged with and disengaged from the driving assembling member along the direction of the rotational driving axial line; a power transmission unit which is disposed between the driving assembling member and the driven assembling member and enables at least one of the driving assembling and the driven assembling member is moveable in the direction of the rotational driving axial line.

25 Claims, 18 Drawing Sheets

IMAGE FORMING APPARATUS AND POWER TRANSMISSION UNIT THEREOF

CROSS-REFERENCE TO RELATED APPLICATIONS

This application claims the benefit of Korean Patent Application No. 2006-116100, filed Nov. 22, 2006, in the Korean Intellectual Property Office, the disclosure of which is incorporated herein by reference.

BACKGROUND OF THE INVENTION

1. Field of the Invention

Aspects of the present invention relate to an image forming apparatus and a power transmission unit thereof, and more particularly, to an image forming apparatus and a power transmission unit in which mechanical or rotational power for a developing device can be easily connected by a user when the developing device is mounted to or detached from the inside of the image forming apparatus.

2. Description of the Related Art

In general, an image forming apparatus outputs a predetermined image onto a printing paper or an electronic file. The image forming apparatus is classified into an electrophotographic type, an ink jet type, and a direct thermal type according to a method by which an image is formed. The electrophotographic type image forming apparatus forms an image through a series of processes, such as electrification, exposure, developing, transfer, and fusing. A laser printer and a photocopier are examples of such an electrophotographic type image forming apparatus.

Recently, among laser printers, a color laser printer which forms a color image by using a plurality of toners, including Yellow, Magenta, Cyan, and Black (YMCK), has become more prevalent. A plurality of developing devices used to accommodate each of the YMCK color toners are provided detachably from a laser printer main body so as to facilitate replacement of the toner and repair of a paper jam.

These developing devices comprise a rotational body such as a photosensitive drum, and a driven assembling member (a male coupling) which is coaxially assembled with the rotational body and receives power from a driving motor (not shown) inside the laser printer when the developing devices are mounted, and a driving assembling member (a female coupling) which is engaged with and disengaged from the driven assembling member coaxially when the developing devices are mounted and is driven by the driving motor.

However, a power transmission unit is needed to engage and disengage the driven assembling member from the driving assembling member when the developing devices are mounted or detached. In Japanese First Publication No. H05-61281, a rotational power selectively connecting apparatus is disclosed to assemble and disassemble a plurality of driven assembling members in one developing device with a plurality of driving assembling members corresponding to the plurality of driven assembling members according to an opening and closing operation of a cover.

However, much force is needed to open and close its cover since the cover and the power transmission unit are assembled with a link so as to engage the opening and closing operation of the cover with an assembling or engaging/disengaging operation of the power transmission unit. In particular, as the number of developing devices or driven assembling members increases, which need to be intermitted, more force is needed to engage/disengage power thereto, thereby causing a user's inconvenience.

Also, if the developing devices have to be mounted and detached or a distance among the driven assembling members is long, such a configuration becomes complicated and lowers compatibility, thereby raising a production cost.

SUMMARY OF THE INVENTION

Accordingly, it is an aspect of the present invention to provide an image forming apparatus and a power transmission unit thereof in which the rotational power of the developing unit can be started and stopped with a small force. Further, a simple configuration and a lower production cost can be obtained.

The foregoing and/or other aspects of the present invention can be achieved by providing an image forming apparatus comprising: a driving component to rotate a driving assembling member about a rotational driving axial line; a developing unit detachably provided in the image forming apparatus has a driven assembling member capable of being engaged with and disengaged from the driving assembling member in a direction of the rotational driving axial line; a power transmission unit to selectively engage a mechanical power to the developing unit; and a manipulating unit to manipulate the power transmission unit such that the power transmission unit is disposed between the driving assembling member and the driven assembling member and enables at least one of the driving assembling member and the driven assembling member to move in the direction of the rotational driving axial line, and the driven assembling member is rotated about the rotational driving axial line by the driving component when the driven assembling member and the driving assembling member are engaged. According to an aspect of the invention, at least one of the driving assembling member and the driven assembling member is elastically pressurized toward the other of the driven assembling member and the driving assembling member.

According to an aspect of the invention, at least one of the driving assembling member and the driven assembling member rotates in a forward direction about the rotational driving axial line and a reverse direction about the rotational driving axial line and is moveable in the direction of the rotational driving axial line, and the power transmission unit includes: a transmission member rotatable in the forward direction and the reverse direction and moveable in the direction of the rotational driving axial line to enable one of the driving assembling member and the driven assembling member to move toward the other of the driving assembling member and the driven assembling member the direction of the rotational driving axial line, and the manipulating unit rotates the transmission member in the forward direction and the reverse direction; and an assembling member which rotates and moves relative to the transmission member as the transmission member rotates in forward and reverse directions.

According to an aspect of the invention, a cam is provided in at least one of the transmission member and the assembling member, and a cam profile is provided in the other one of the transmission member and the assembling member and the cam profile guides the movement of the cam.

According to an aspect of the invention, the transmission member and the assembling member are provided in a cylindrical shape. According to an aspect of the invention, an inside surface of the transmission member is supported by an outside surface of the assembling member. According to an aspect of the invention, the cam extends from one of the inside surface of the transmission member and the outside surface of the assembling member, and the cam profile is formed to complement the cam. According to an aspect of the invention, the inside diameter of the transmission member is larger than an inside diameter of the assembling member and the inside diameter of the transmission member is smaller than the outside diameter of the assembling member.

According to an aspect of the invention, the cam is provided in at least one of a facing end of the transmission member and the assembling member, and the cam profile is provided in the other of the facing end of the transmission member and the facing end of the assembling member. The outside surface of the transmission member is supported on the inside surface of the assembling member. According to an aspect of the invention, the cam extends from at least one of the outside surface of the transmission member and the inside surface of the assembling member, and the cam profile is formed to complement the cam.

According to an aspect of the invention, the power transmission unit further comprises: an operating member to receive a rotational force to rotate the transmission member in the forward direction; and a biasing device to rotate the transmission member in the reverse direction if the rotational force is less than a biasing force applied by the biasing device. According to an aspect of the invention, the power transmission unit comprises: a fixing pin with which one end of the biasing device is coupled to the assembling member; and an elastic pressure lever coupled to an other end of the biasing device and elastically pressurized to rotate in the reverse direction. According to an aspect of the invention, the elastic pressure lever comprises a plate disposed in a transverse direction with respect to the rotational driving axial line, and an engagement rotational projection projected from the plate toward the operating member, and the operating member comprises a hole into which the engagement rotational projection is inserted.

According to an aspect of the invention, the cam comprises a sliding projection provided in a direction crossing the rotational driving axial line so that the transmission member is slidable toward the assembling member when the transmission member rotates in a forward direction. According to an aspect of the invention, the cam comprises a movement restriction projection provided in a transverse direction with respect to the rotational driving axial line to restrict the transmission member from moving toward the assembling member in the direction of the rotational driving axial line. According to an aspect of the invention, the cam comprises a forward rotation restriction projection provided in a direction parallel to the rotational driving axial line so as to restrict a forward rotation of the transmission member. The cam may comprise a sliding projection cross the rotational driving axial line at an acute angle; a movement restriction projection which to extend from the sliding projection in a transverse direction with respect to the rotational driving axial line to restrict the transmission member from moving toward the assembling member in a direction of the rotational driving axial line; and a forward rotation restriction projection to extend from the movement restriction projection in a direction parallel to the rotational driving axial line so as to restrict the forward rotation of the transmission member. The manipulating unit comprises an actuator which applies a rotational force to the power transmission unit.

According to an aspect of the invention, provided is a power transmission unit for an image forming apparatus including a driving component comprising a driving assembling member moveable in a direction of a rotational driving axial line; a driven assembling member which is capable of being engaged with and disengaged from the driving assembling member in the direction of the rotational driving axial line; a transmission member in at least one of the driving assembling member and the driven assembling member to rotate about and move in the direction of the rotational driving axial line; and an assembling member which rotates relative to the transmission member.

According to an aspect of the invention, a cam is provided in at least one of the transmission member and the assembling member, and a cam profile to guide the movement of the cam is provided in the other of the at least one of the transmission member and the assembling member. The cam may comprise a sliding projection provided in a direction to cross the rotational driving axial line so that the transmission member is slidable toward the assembling member when the transmission member rotates in a forward direction. The cam may comprise a movement restriction projection provided in a transverse direction with respect to the direction of the rotational driving axial line to restrict the transmission member from moving toward the assembling member in the direction of the rotational driving axial line. The cam may comprise a forward rotation restriction projection provided in a direction parallel to the rotational driving axial line so as to restrict a forward rotation of the transmission member.

According to an aspect of the invention, the power transmission unit of the image forming apparatus further comprises: an operating member which receives a rotational force to rotate the transmission member in a forward direction; and a biasing device to apply a biasing force to rotate the transmission member in a reverse direction when the rotational force is less than the biasing force. The power transmission unit of the image forming apparatus may include: a fixing pin with which one end of the elastic member is coupled; and an elastic pressure lever coupled to an other end of the biasing device and elastically pressurized to rotate the transmission member in the reverse direction.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
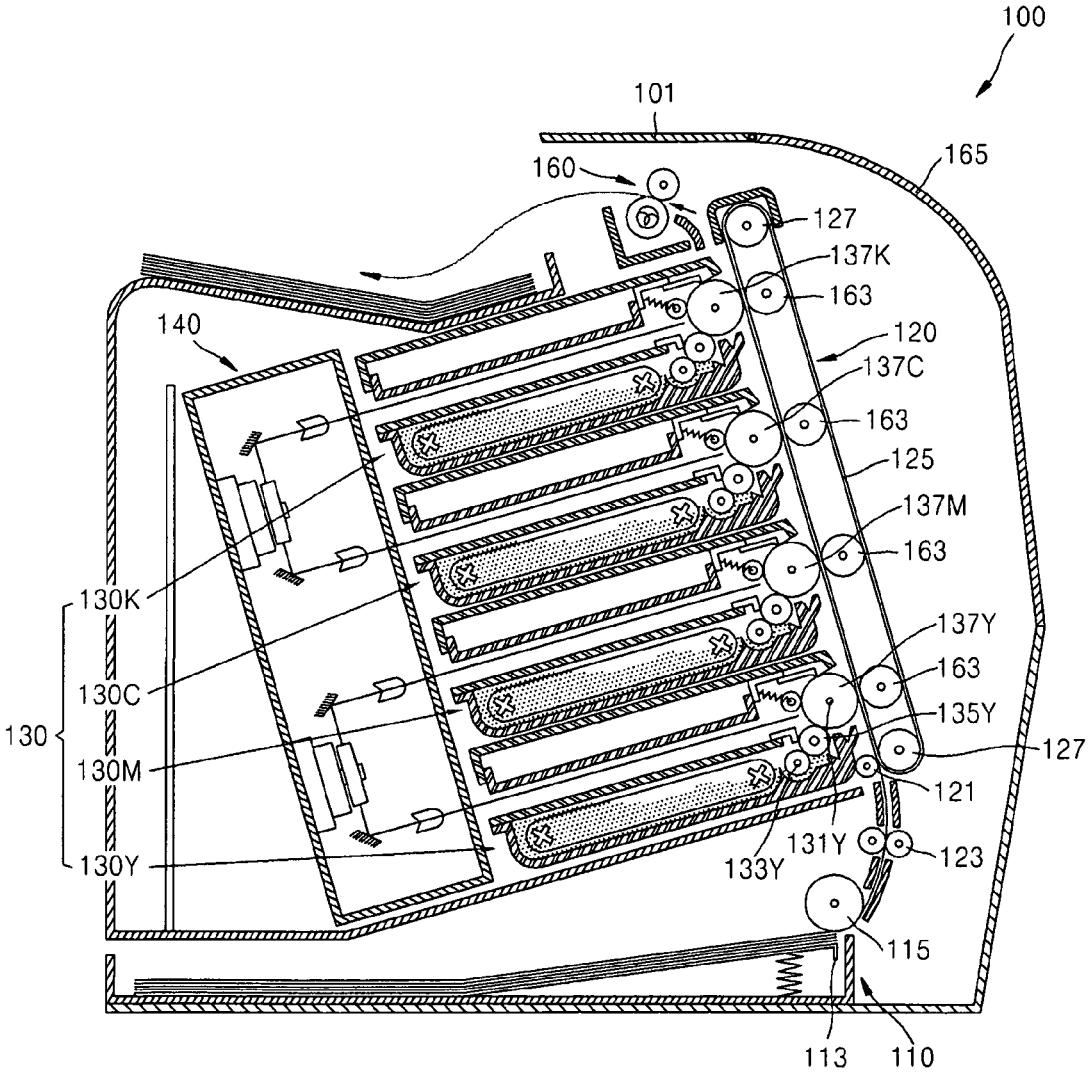
FIG. 1 is a cross-sectional view of an image forming apparatus according an example embodiment to the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

As shown in FIG. 1, the image forming apparatus 100 according to aspects of the present invention comprises a paper feeding unit 110, a paper transferring unit 120, a developing unit 130, a light scanning unit 140, and a fusing unit 160.

A printing paper stored in a paper feeding cassette 113 is picked up by a pick-up roller 115 and fed toward a paper transfer belt (PTB) 125 through a feed roller 123. The fed printing paper is electrified by a paper electrifying roller 121 to an electric charge opposite to the electrifying electric charge of the PTB 125. The electrified paper is adsorbed onto the PTB 125 by an electric attraction as the electrified paper and the PTB 125 have opposite electric charges, and the electrified paper is fed toward the developing unit 130.

Figure 2:
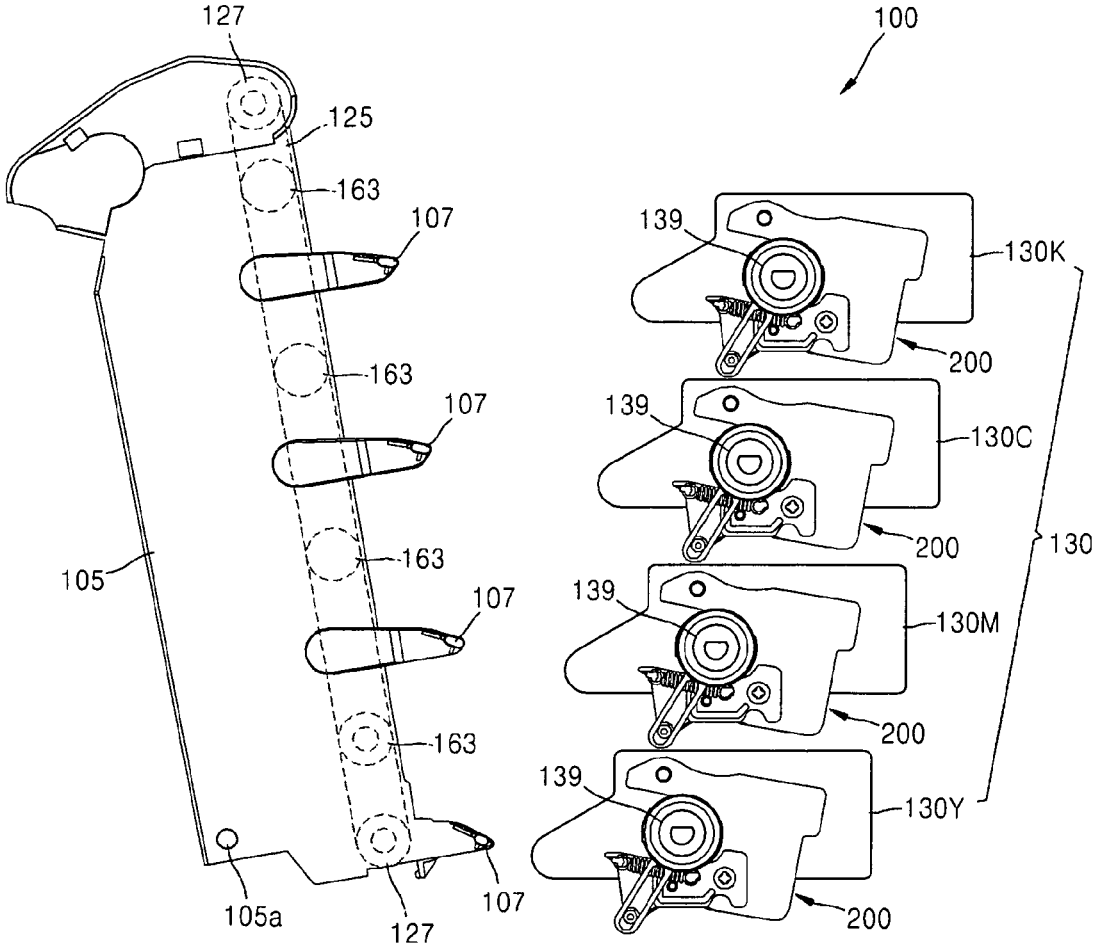
FIG. 2 is a side view of a main part of the image forming apparatus shown in FIG. 1.

A PTB driving roller 127 circulates a track of the paper transfer belt 125 and transfer rollers 163. The PTB driving roller 127 and the transfer rollers 163 are rotationally supported by a side frame 105 (of FIG. 2), which is disposed on a side of the image forming apparatus 100. A cover 165 is provided to protect the internal workings of the image forming apparatus 100. As shown in FIG. 2, the side frame 105 may be provided to rotate with respect to a hinge pin 105*a* so as to solve a paper jam if the paper jam happens in the PTB 125. Accordingly, since the side frame 105 rotates with the transfer roller 163 and the PTB driving roller 127, the developing unit 130 can be mounted and detached more easily.

The developing unit 130 is disposed inside a main body 101 which includes a detachable yellow developing element 130Y storing a yellow toner, a magenta developing element 130M storing a magenta toner, a cyan developing element 130C storing a cyan toner, and a black developing element 130K storing a black toner. Also, the developing unit 130 may be arranged differently from that shown in FIG. 1. Here, the yellow developing element 130Y will be briefly described since each of the respective developing elements 130Y, 130M, 130C, and 130K has the same configuration and only a color of the toner accommodated is different.

The yellow developing element 130Y comprises a supplying roller 133Y, a developing roller 135Y, and a photosensitive drum 137Y. The photosensitive drum 137Y comprises a drum rotational axis 131Y having the rotational driving axial line A (shown in FIG. 3) as a center line. The photosensitive drum 137Y, as well as the other photosensitive drums 137M, 137C, 137K, may be referred to as a developing component. Also, in one end of the drum rotational axis 131Y is installed a driven assembling member 139 shown in FIG. 3B which is exposed to the outside of the developing unit 130.

The photosensitive drum 137Y receives a rotational power from the driving assembling member 103 to rotate, and its surface is exposed by the light scanning unit 140 to form an electrostatic latent image corresponding to a yellow image. The electrostatic latent image is developed into a toner visible image by a developing roller 135Y which is supplied with yellow toner by a supplying roller 133Y. Also, the toner visible image is transferred to a printing paper fed to the yellow developing element 130Y by the transfer roller 163. In this way, as the printing paper proceeds along the PTB 125, yellow, magenta, cyan, and black toner visible images are overlapped and a complete color toner visible image is formed on the printing paper. After that, the printing paper, or any suitable printable medium, for example, paper, transparency sheets, on which the color toner visible image is formed, passes through the fusing unit 160 to be fused and discharged to the outside.

Figure 4A:
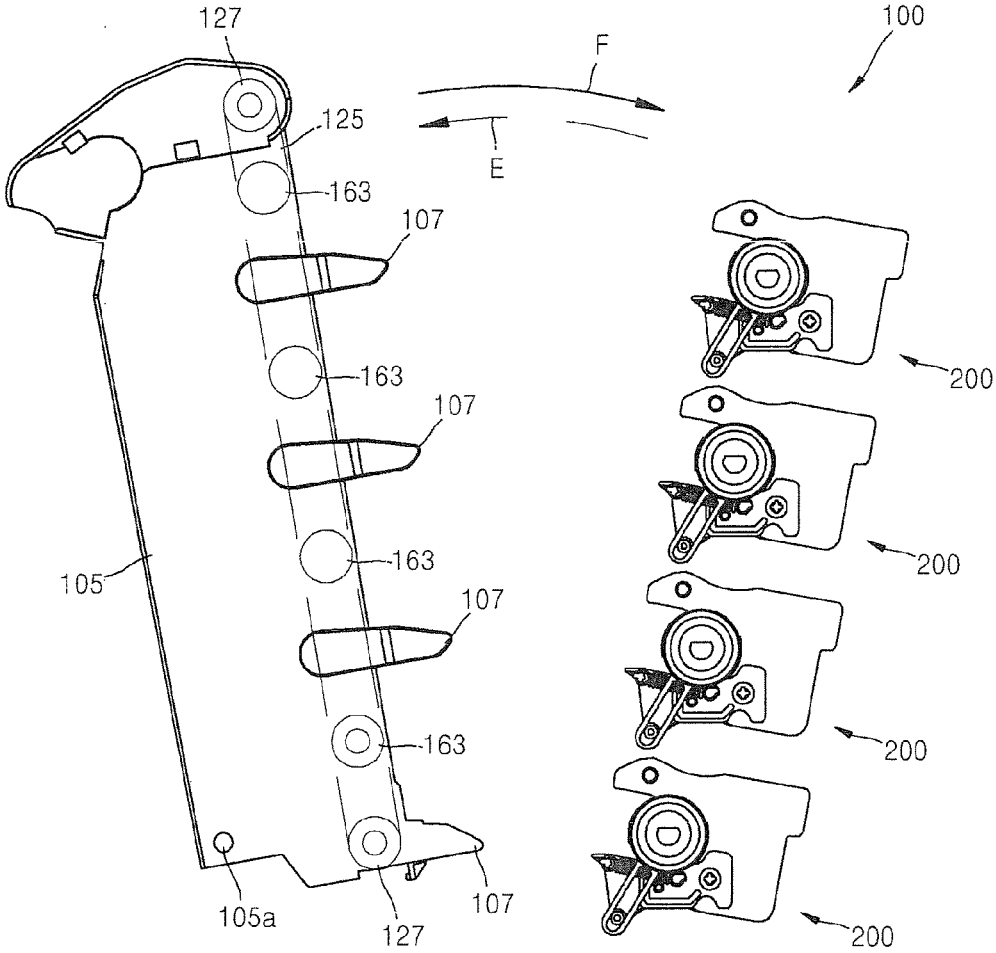
FIGS. 4A and 4B are side views of a main part illustrating an operating process of the power transmission unit when the side frame of the image forming apparatus shown in FIG. 1 is rotationally opened and closed.
Figure 4B:
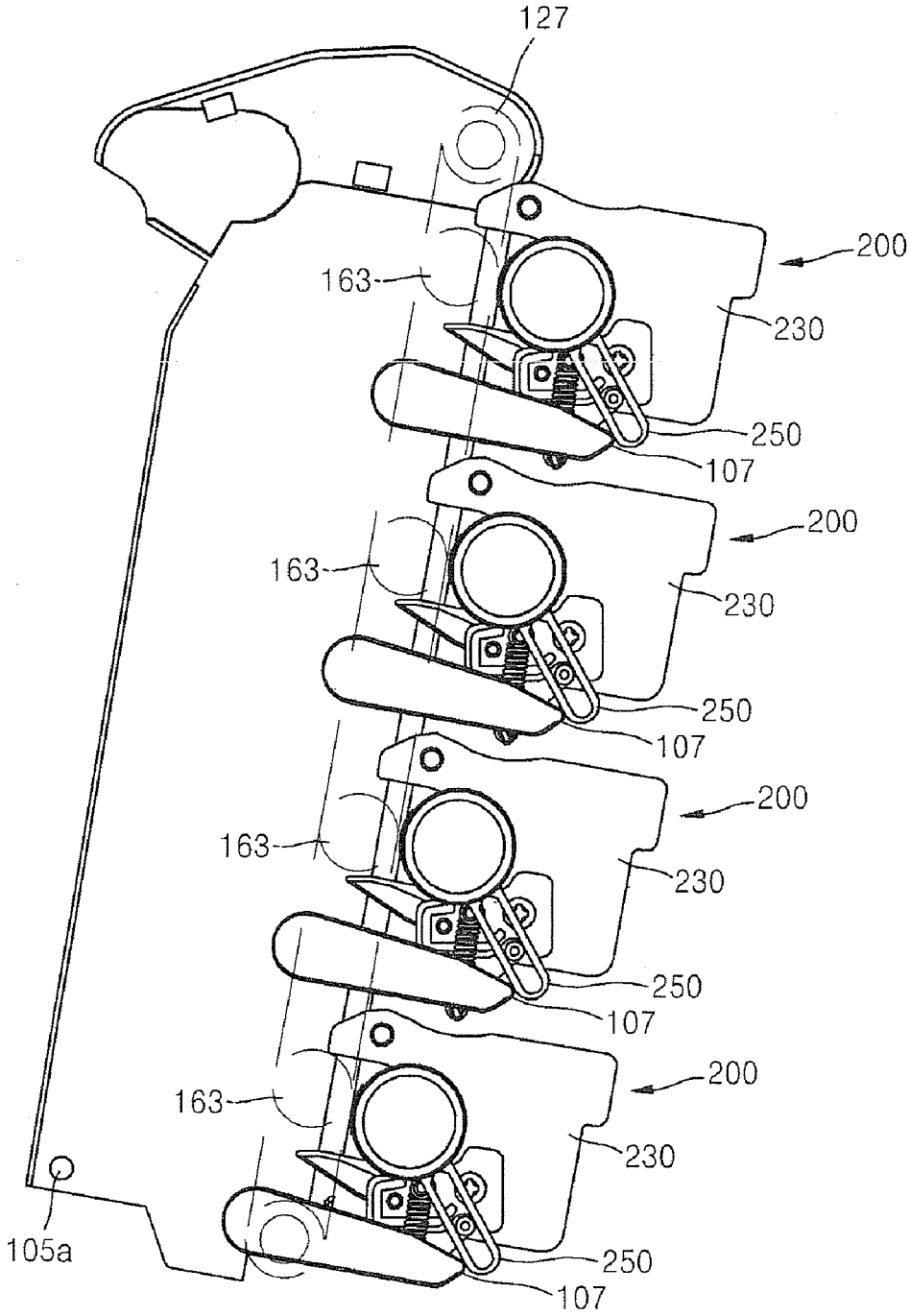

With regard to FIG. 2, an actuator 107 is provided to be projected or to extend toward an operating member 250. The actuator 107 may be integrated with the side frame 105 in an aspect of productivity such that actuator 107 begins the operation of a corresponding power transmission unit 200 when a side frame 105 is rotated about a hinge pin 105*a* so that the actuator 107 contacts the operating member 250 (as shown in FIG. 4B). The actuator 107 may be manufactured of a material having elasticity such as a soft plastic so as to relieve impact when the operating member 250 is pressurized. Further, when the side frame 105 rotates about the hinge pin 105*a* toward the power transmission unit 200, the PTB 125 is also rotated so that the PTB 125 may transfer paper along the developing unit 130 and the transfer rollers 163 may align with the photosensitive drums 137 of the developing unit 130. To accomplish such transfer of paper by the PTB 125, the PTB 125 is driven by the PTB driving rollers 127. As illustrated in FIG. 2, a plurality of actuators 107 is provided to engage a plurality of operating members 250 each of which corresponds to a power transmission unit 200. The actuators 107, the operating members 250, and the power transmission units 200 correspond to a number of colors to be applied to the paper for printing. According to aspects of the current invention, a plurality of power transmission units 200 are used to apply and cut-off power to the yellow, magenta, cyan, and black developing elements 130Y, 130M, 130C, and 130K, respectively. However, the power transmission units 200 are not limited thereto. Further, the driven assembling members 139, again associated with each color, are illustrated and are driven by the corresponding driving assembling members 103.

Figure 3A:
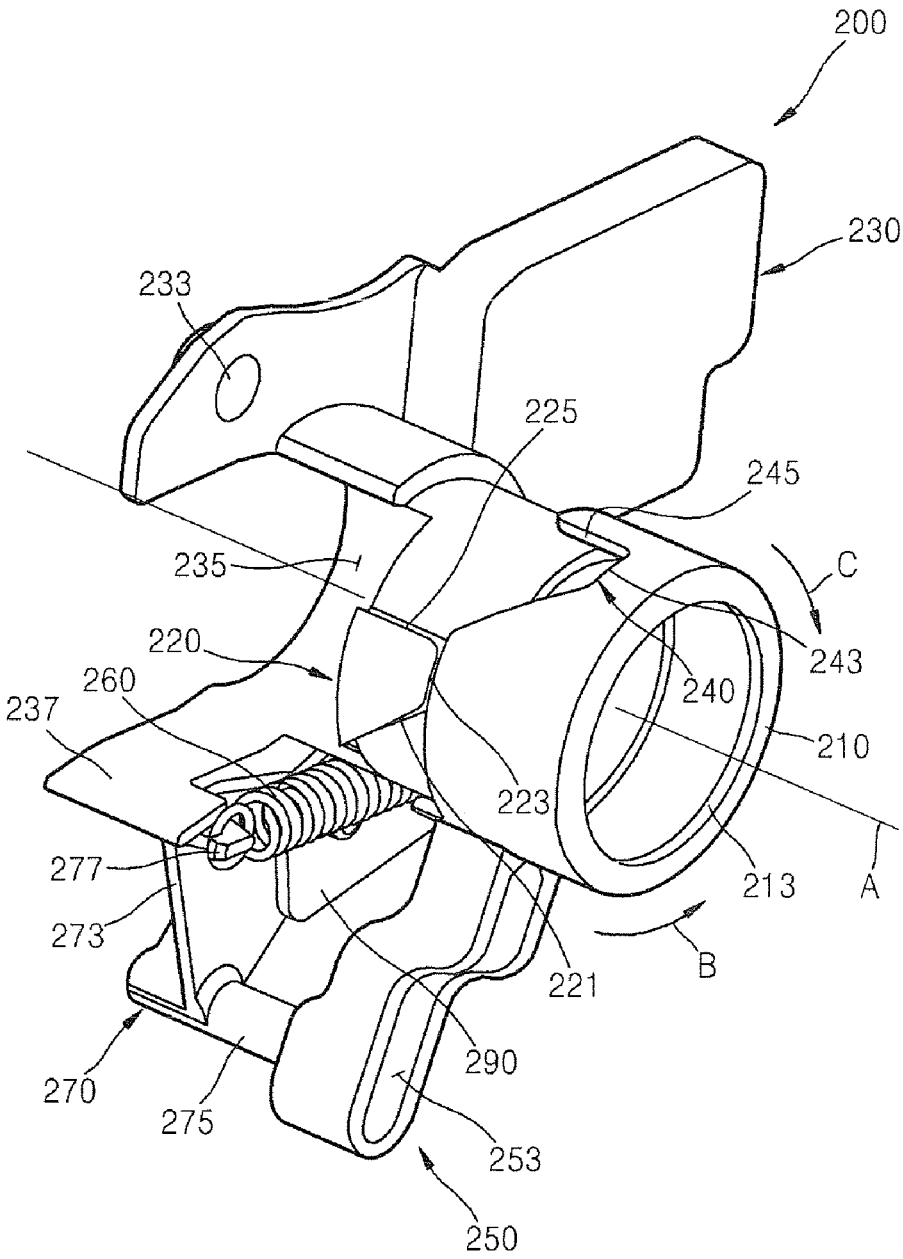
FIG. 3A is a perspective view of a power transmission unit of the image forming apparatus shown in FIG. 1.
Figure 3B:
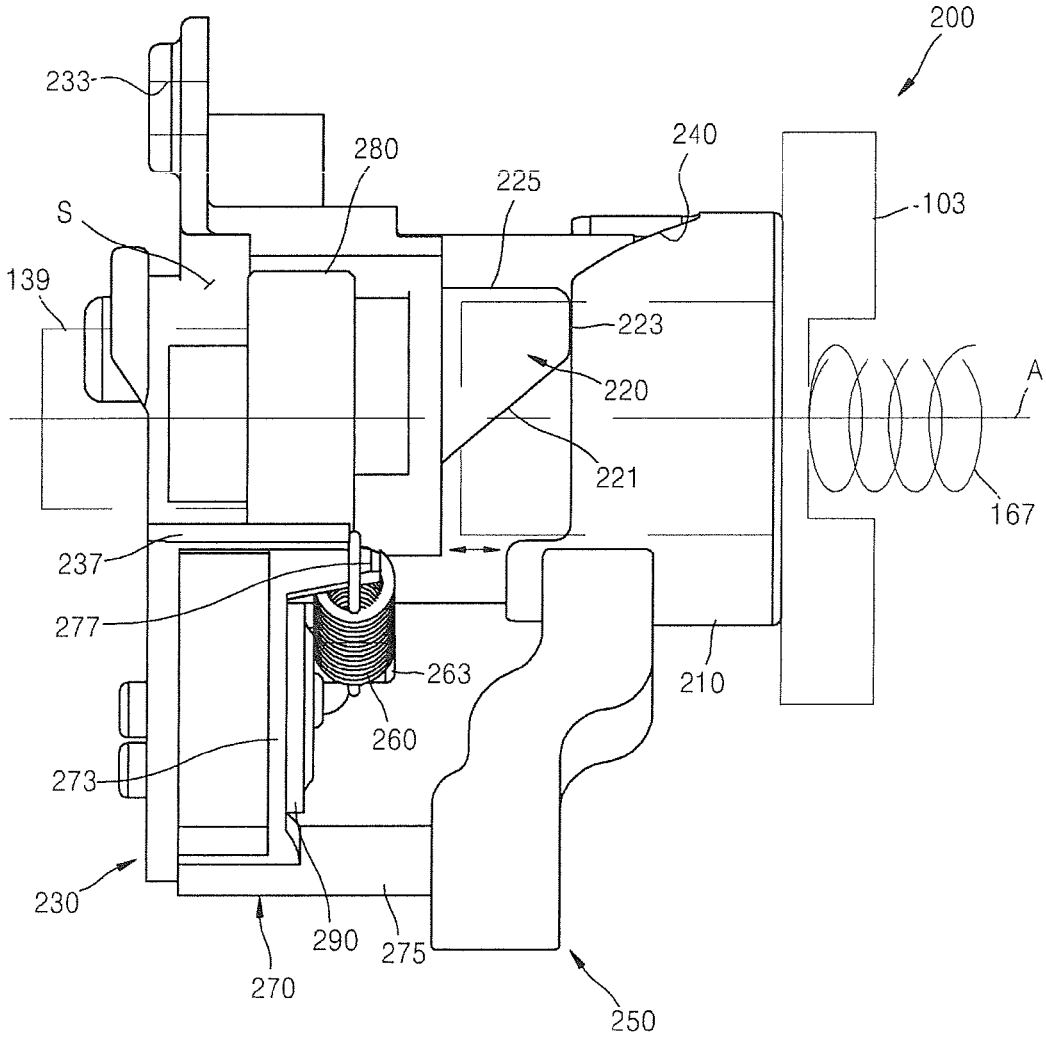
FIG. 3B is a side view of the power transmission unit shown in FIG. 3A.
Figure 6:
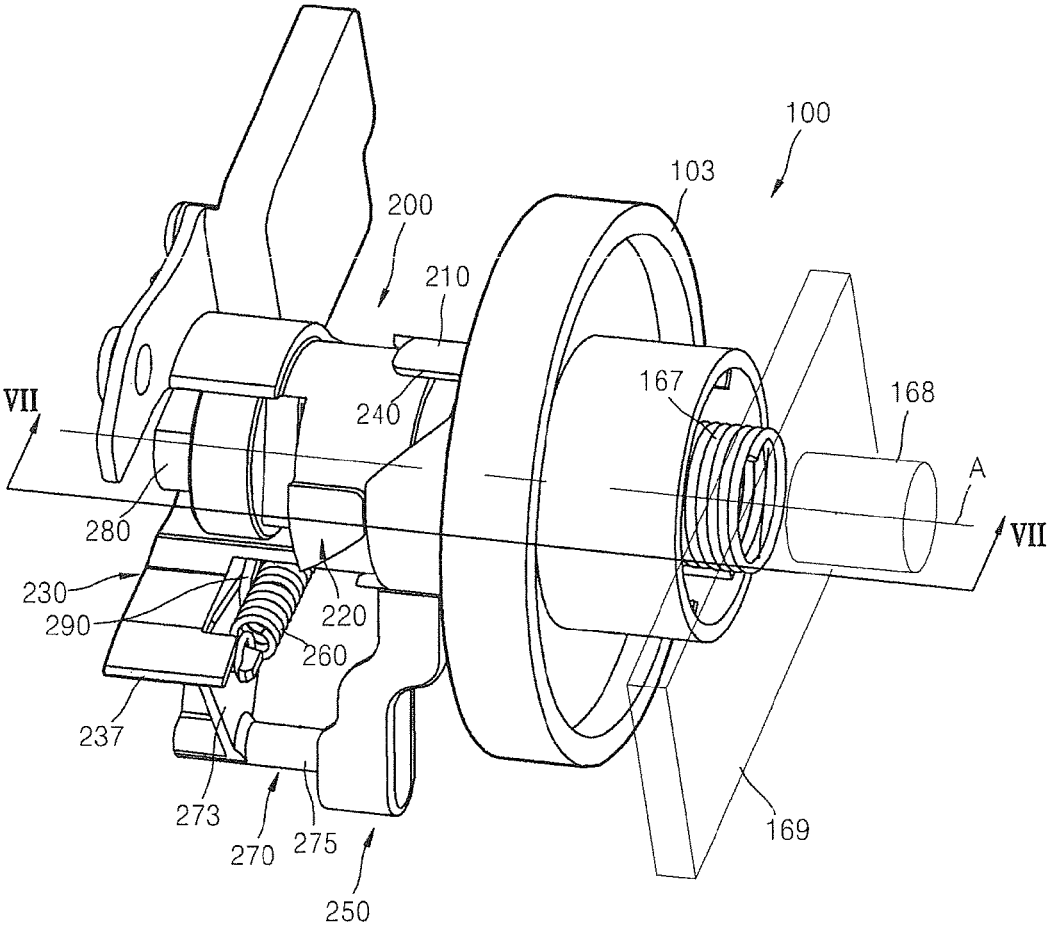
FIG. 6 is a perspective view of the main part of the image forming apparatus shown in FIG. 1.
Figure 7:
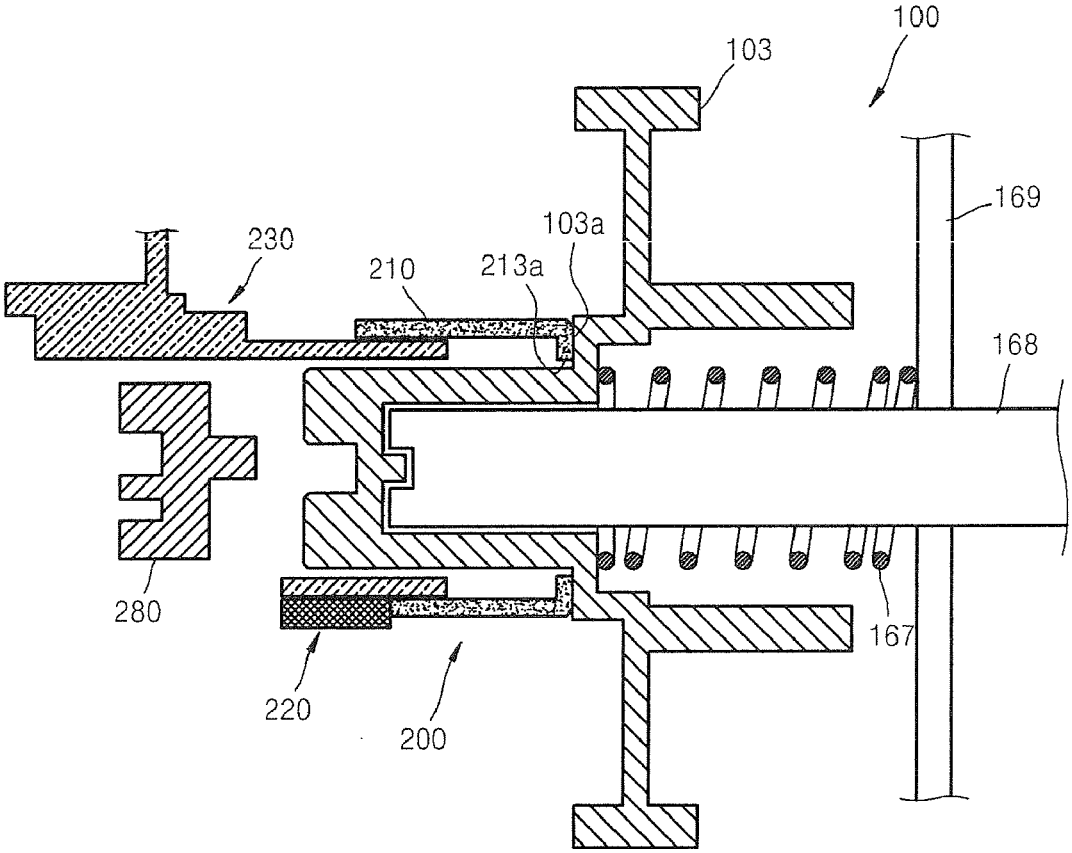
FIG. 7 is a sectional view according to a line VII-VII shown in FIG. 6.

The image forming apparatus 100 according to aspects of the present invention further comprises the power transmission unit 200. FIG. 3A is a perspective view of a power transmission unit 200 in which the driving assembling member 103 and the driven assembling member 139 are omitted for convenience of description. FIG. 3B is a side view of FIG. 3A comprising the driving assembling member 103 and the driven assembling member 139. FIGS. 6 and 7 are a perspective view of a main part and a cross sectional view of the image forming apparatus comprising the driving assembling member 103 and the additional coupling 280.

As shown in FIG. 3B, the driven assembling member 139 is assembled with a driving assembling member 103 rotationally supported in the internal frame (not shown) in the inside of the main body 101 (FIG. 1) to receive a rotational power therefrom. The driving assembling member 103 is assembled with a driving motor (not shown). The driven assembling member 139 and the driving assembling member 103 are provided to engage and disengage with/from each other in the direction of the drum rotational axis 131Y of the photosensitive drum 137Y; alternatively, the driven assembling member 139 and the driving assembling member 103 engage and disengage along the rotational driving axial line A. The driven assembling member 139 and the driving assembling member 103 are provided as a pair of couplings. That is, if the driven assembling member 139 is provided as a female coupling, the driving assembling member 103 may be provided as a male coupling. However, the driven and driving assembling members 139 and 103, respectively, are not limited thereto, and the driven assembling member 139 may comprise the male coupling, and the driving assembling member 103 may comprises the female coupling.

As shown in FIGS. 6 and 7, between the driven assembling member 139 and the driving assembling member 103 may be provided an additional coupling 280. The additional coupling 280 is engageable along the rotational driving axial line A with the driven assembling member 139 and the driving assembling member 103 of which the opposite ends face each other. The additional coupling 280 may be omitted, as necessary.

Figure 8:
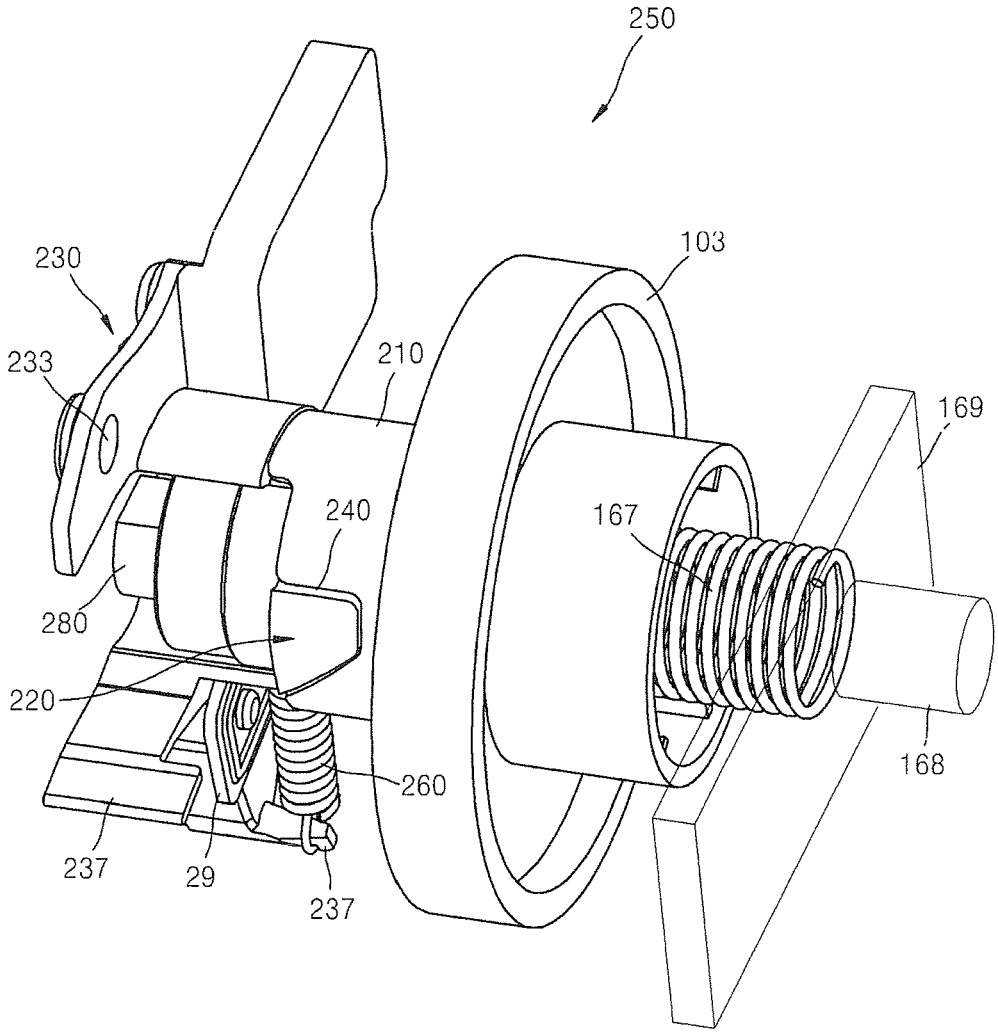
FIG. 8 is a perspective view of the main part in a power-transmission state of the image forming apparatus shown in FIG. 1.

As shown in FIGS. 3B, 7, and 8, one end of the driving assembling member 103 is assembled with a transmission member 210, and an opposite end thereof is assembled with a driving axle 168. Also, a frame 169 supports the driving axle 168 about which a biasing device 167 is provided to elastically pressurize the driving assembling member 103 toward the driven assembling member 139. Accordingly, the transmission member 210 is elastically pressurized toward an assembling member 230.

Meanwhile, the image forming apparatus 100 according to aspects of the present invention further comprises a manipulating unit (not shown) which manipulates the power transmission unit 200 shown in FIG. 3A. The manipulating unit aids in the rotation of the transmission member 210 or the assembling member 230 of the power transmission unit 200. Also, the manipulating unit may be provided to facilitate the rotation of both, individually or simultaneously, the transmission member 210 and the assembling member 230. The manipulating unit may drive the power transmission unit 200 by comprising an electric driving motor.

Also, the manipulating unit may select one of those designed to be first opened when detaching the developing unit 130 in consideration of production cost. Here, the manipulating unit may be provided as a cover 165 (FIG. 1) which must be first opened so as to mount or detach the developing elements 130Y, 130M, 130C, and 130K. However, the side frame 105 (FIG. 2) may be selected as the manipulating part. As the side frame 105 is disposed closer to the developing unit 130 than the cover, an actuator 107 (FIG. 2) having a shorter length may be provided to manipulate the power transmission unit 200.

A direction in which the transmission member 210 rotates so that the transmission member 210 and the assembling member 230 can approach each other along the rotational driving axial line A shown in FIG. 3A is set as a forward direction B in 3A, and the direction in which the transmission member 210 rotates so that the transmission member 210 and the assembling member 230 can be separated from each other is set as a reverse direction C.

As shown in FIGS. 3B, 6, and 7, the power transmission unit 200 is provided between the driving assembling member 103 and the driven assembling member 139 of the developing unit 130. The power transmission unit 200 comprises the transmission member 210 and the assembling member 230.

As shown in FIG. 3A, the transmission member 210 has a through hole 213 inside thereof so that the driving assembling member 103 can reciprocally move. The transmission member 210 is can accommodate various sizes of the driving assembling members 103 by the relatively large size of the through hole 213.

Meanwhile, the transmission member 210 may be provided in a cylindrical shape so as to approach and be separated along the rotational driving axial line A to rotate relative to the assembling member 230. Also, as shown in FIG. 3A, an inside surface of the transmission member 210 may be supported on the outside surface of the assembling member 230 since an inside diameter of the transmission member 210 is sufficiently larger than an outside diameter of the assembling member 230. Accordingly, the transmission member 210 can relatively move and rotate with respect to the assembling member 230. Also, on a frictional surface between the transmission member 210 and the assembling member 230 may be sprayed with a lubricant (not shown).

Also, as shown in FIGS. 3A and 3B, the transmission member 210 is provided with a cam profile 240 in its opposite end disposed nearer to the assembling member 230. The cam profile 240 contacts a cam 220 so as to at least relatively rotate with respect to each other in the directions of forward and reverse directions B and C and move the first and assembling members 210 and 230 towards or away from each other in the direction of the rotational driving axial line A.

The cam profile 240 may be provided in a shape corresponding to the shape of the cam 220. Although the cam profile 240 is provided to pass through the inside and the outside surfaces of the transmission member 210 shown in FIGS. 3A and 3B, the cam profile 240 is not limited thereto. The cam profile 240 may be provided in the shape of a groove which does not pass through the outside surface of the transmission member 210, if the transmission member 210 is sufficiently thick. The cam profile 240 may be provided in various shapes as long as the cam 220 can approach and be separated toward/from the assembling member 230.

If there is not a forward rotation force or moment applied by the actuator 107 shown in FIG. 2 or if the actuator 107 has not applied a pressure to the operating member 250 so as to cause the transmission member 210 to rotate, the transmission member 210 and the assembling member 230 are disposed such that the cam 220 and the cam profile 240 are positioned in a predetermined interval along the direction so that the transmission member 210 and the assembling member 230 can be in a separated state in the direction of the rotational driving axial line A.

As shown in FIGS. 3A and 3B, the assembling member 230 is fixedly-coupled to a fixing frame (not shown) of the inside of the image forming apparatus 100 by a coupling hole 233 and supports one end of the transmission member 210. Also, the assembling member 230 has a space 235 which accommodates the driven assembling member 139. Also, the additional coupling (see 280 shown in FIG. 7) may be accommodated in the space 235 to be disposed between the driven assembling member 139 and the driving assembling member 103 in the direction of the rotational driving axial line A. Also, on the outside surface of the assembling member 230 is formed the cam 220 which operates with the cam profile 240 of the transmission member 210.

As shown in FIGS. 3A and 3B, the cam 220 comprises a sliding projection 221 on its outside surface in a direction to cross the rotational driving axial line A. The sliding projection 221 enables the transmission member 210 to slidingly approach the assembling member 230 in the direction of the rotational driving axial line A if the transmission member 210 rotates in the forward direction B. The sliding projection 221 slides down a face of the cam profile 240 so as to allow the first and assembling members 210 and 230 to approach each other. Upon full sliding of the sliding projection 221, the cam 220 and the cam profile 240 are fully engaged.

Also, as shown in FIGS. 3A and 3B, the cam 220 may further comprise a movement restriction projection 223 which is provided on its outside surface along a transverse direction with respect to the rotational driving axial line A, in other words, in a direction that crosses the rotational driving axial line A and may be perpendicular to the rotational driving axial line A. The movement restriction projection 223 maintains a separated state of the transmission member 210 along the rotational driving axial line A with respect to the assembling member 230 if the transmission member 210 rotates in a reverse direction. That is, the movement restriction projection 223 restricts the movement of the transmission member 210 in the direction of the rotational driving axial line A and maintains a distance between the first and assembling members 210 and 230. Further, the movement restriction projection 223 slides toward the cam profile 240 along the one end of the transmission member 210 to engage the movement restriction profile 243 when the transmission member 210 is rotated in the forward direction B, and the movement restriction projection 223 slides away from the cam profile 240 along the one end of the transmission member 210 when the transmission member 210 is rotated in the reverse direction C. When the transmission member 210 is fully rotated in the forward direction B, the movement restriction projection and profile 223 and 243 engage in a complementary fashion.

Furthermore, as shown in FIGS. 3A and 3B, the cam 220 may further comprise a forward rotation restriction projection 225 on its outside surface in a direction parallel to the rotational driving axial line A. The forward rotation restriction projection 225 prevents the transmission member 210 from rotating in a forward direction if the transmission member 210 rotates in the forward direction B along the movement restriction projection 223 and the sliding projection 221 by pressure of the actuator 107 shown in FIG. 2. The actuator 107 forces the transmission member 210 to rotate in the forward direction B until such forward rotation is prevented by the contact of the forward rotation restriction projection 225 with the forward rotation restriction profile 245. The transmission member 210 rotates and approaches the assembling member 230, and the driving assembling member 103 and the driven assembling member 139 are thereby engaged. The rotation of the transmission member 210 is prohibited by the contact between the forward rotation restriction projection and profile 225 and 245, respectively, so that the transmission member 210 does not interfere with other neighboring members as may occur if the transmission member 210 continues to rotate in the forward direction B. Here, the forward rotation restriction projection 225 may be omitted if the transmission member 210 can be prevented from rotating in the forward direction B more so than necessary by engagement of the operating member 250 with the actuator 107. A biasing device 260 may be configured to apply elasticity to the transmission member 210 in the reverse direction C to oppose movement of the transmission member 210 in the forward direction B. However, the forward rotation projection 225 may be advantageous so as to prevent an excessive forward rotation of the transmission member 210.

The sliding projection 221, the movement restriction projection 223, and the forward rotation restriction projection 225 are integrally formed in FIGS. 3A and 3B, but they may be separately-provided. Also, the cam 220 may be provided in various shapes without limitation to the shapes illustrated and described.

As shown in FIGS. 3A and 3B, the power transmission apparatus 200 according to aspects of the current invention may further comprise the operating member 250 and a biasing device 260.

The operating member 250 is disposed on the transmission member 210, which is capable of rotating and moving, as the assembling member 230 is fixed. The actuator 107 approaches, contacts, and applies pressure to the operating member 250, which then causes the transmission member 210 to rotate in the forward direction B as the side frame (see 105 shown in FIG. 2) provided as the manipulating unit rotationally approaches the developing elements 130Y, 130M, 130C, and 130K. If a member capable of integrally rotating with the transmission member 210, like an elastic pressure lever 270, in addition to the operating member 250 is further added, the actuator 107 shown in FIG. 2 applies pressure to the elastic pressure lever 270 instead of the operating member 250.

The operating member 250 and the transmission member 210 may be integrally formed in consideration of productivity. Also, the operating member 250 may be formed having a hole 253 through which an engaging rotational projection 275 of the elastic pressure lever 270 is inserted so that the operating member 250 integrally rotates with the elastic pressure lever 270. However, the operating member 250 is not limited thereto. The operating member 250 may comprise a groove into which the engaging rotational projection 275 is inserted.

Meanwhile, as shown in FIGS. 3A and 3B, the biasing device 260 rotates the transmission member 210 in the reverse direction C if the actuator 107 releases pressure on the transmission member 210. The transmission member 210, which rotates in the reverse direction C, is guided by contact with the cam profile 240 and the cam 220 so as to separate from the assembling member 230 along the rotational driving axial line A. Also, if the forward and the reverse rotations of the transmission member 210 are driven, the biasing device 260 may be omitted. An electric driving motor (not shown) may be provided in the manipulating unit to rotate the transmission member 210 in the forward and reverse directions B and C.

The biasing device 260 has been illustrated to be assembled with the elastic pressure lever 270 in FIGS. 3A and 3B, but the biasing device 260 may be assembled with any member such as the operating member 250 or on the outside surface of the transmission member 210 as long as the biasing device 260 can at least enable the transmission member 210 to rotate in the reverse direction C.

Meanwhile, the power transmission unit 200 according to aspects of the current invention may further comprise the elastic pressure lever 270. As shown in FIGS. 3A and 3B, the elastic pressure lever 270 enables the transmission member 210 to rotate in the reverse direction C due to the elasticity of the biasing device 260. Also, if the elastic pressure lever 270 is provided to be engaged with the transmission member 210, the actuator 107 may apply pressure to the elastic pressure lever 270 instead of the transmission member 210.

The elastic pressure lever 270 comprises a plate 273, and an engaging rotational projection 275 extending from the plate 273 in a direction parallel to the rotational driving axial line A, and a hitching hook (or loop) 277 to which one end of the biasing device 260 is coupled. Here, as shown in FIG. 3B, one opposite end of the biasing device 260 is assembled with a fixing pin 263 which is in a position separate from the rotational driving axial line A. The elastic pressure lever 270 may be formed with the plate 273 for an aspect of productivity.

The plate 273 is provided to rotate about a plate rotational axis 273*a* (FIG. 5), which is parallel to the rotational driving axial line A. Also, a separation prevention plate 290 may be provided to prevent the plate 273 from being separated in the direction of the plate rotational axis 273*a*.

The engaging rotational projection 275 is inserted in the hole 253 of the operating member 250 to enable the elastic pressure lever 270 and the transmission member 210 to engagedly rotate. Here, the hole 253 may be formed along a lengthwise direction of the operating member 250. The hole 253 is to prevent the engaging rotational projection 275 and the hole 253 of the operating member 250 from interfering with each other while rotating since the plate 273 and the transmission member 210 do not rotate about the same axis. That is, for the engaging rotational projection 275 to move along the lengthwise direction of the hole 253 while the engaging rotational projection 275 rotates with respect to the plate rotational axis 273*a*, the inserting hole 253 is properly formed in consideration of such aspect.

Meanwhile, the positions of the hitching hook 277 and the fixing pin 263 are properly determined so as to apply elasticity such that the transmission member 210 can rotate in the reverse direction C if the pressure is released by the actuator 107. Also, the assembling member 230 may include an elastic pressure lever 237 that prevents excessive reverse rotation in the reverse direction C of the elastic pressure lever 270. That is, the elastic pressure lever 237 restricts a range of angles or rotation of the reverse rotation in the reverse direction C of the elastic pressure lever 270. Here, the angle range of the reverse rotation C of the elastic pressure lever 270 is properly determined in consideration of a movement or displacement of the transmission member 210 and the shape of the cam 220 necessary for disengaging the driving assembling member 103 and the driven assembling member 139.

Hereinafter, an operating process of the power transmission unit 200 according to aspects of the current invention will be described by referring to FIGS. 4A to 5B. As the elements in the drawings maintain the same element numbers, repetitive description of elements is omitted. As shown in FIG. 4A, if the side frame 105 is rotationally opened in a direction E so as to detach the developing elements (130Y, 130M, 130C, and 130K shown in FIG. 1) from the PTB 125, the actuators 107 formed in the side frame 105 release pressure from the operating members 250. The side frame 105 rotates in the direction E away from the power transmission units 200 and rotates about hinge pin 105*a*. Accordingly, the elastic pressure lever 270 rotates in the reverse direction C from the state of FIG. 5B to the state FIG. 5A due to pressure applied thereto by the biasing device 260. The biasing device 260 exerts a compressive force between the hitching hook 277 and the fixing pin 263 in the direction opposite to direction D shown in FIG. 5B. Thus, the operating member 250 assembled with the engaging rotational projection 275 of the elastic pressure lever 270 through the hole 253 and the transmission member 210 integrally rotate in the reverse direction C. The transmission member 210 is separated from the assembling member 230 by the sliding projection 221 shown in FIG. 3A of the cam 220 of the assembling member 230 while the transmission member 210 rotates in the reverse direction C. The transmission member 210 is separated from the assembling member 230 in the rotational driving axial line A such that the movement restriction projection 223 of the assembling member 230 engages an end of the transmission member 210. Accordingly, the driven assembling member 139 and the driving assembling member 103 are disengaged and thus driving power is blocked to the photosensitive drums 137Y, 137M, 137C, and 137K of the developing elements 130Y, 130M, 130C, and 130K.

In FIG. 4A, as the side frame 105 is rotated in the direction F toward the power transmission units 200, the actuators 107 engage the operating members 250 as shown in FIG. 4B. As shown in FIG. 4B, if the side frame 105 is rotationally closed in a direction F after the developing elements 130Y, 130M, 130C, and 130K are mounted to the image forming apparatus 100, the actuators 107 formed in the side frame 105 apply pressure to the operating members 250. Or, the side frame 105 rotates in the direction F toward the power transmission units 200 and rotates about the hinge pin 105*a* such that the actuators 107 engage the operating members 250. FIG. 4B illustrates the situation in which the side frame 105 has fully rotated in the direction F toward the power transmission units 200. Accordingly, the transmission member 210 rotates forward from the state FIG. 5A to the state FIG. 5B. The movement restriction projection 223 shown in FIG. 3A slides along one end of the transmission member 210 until the cam 220 begins to overlap the cam profile 240 at which point the sliding projection 221 shown in FIG. 3A continues into the cam profile 240 until the movement restriction projection and profile 223 and 243 engage. If the movement restriction profile 243 shown in FIG. 3A of the cam, profile 240 formed in the transmission member 210 contacts the movement restriction projection 223 in its moving process, the transmission member 210 does not further move in the direction of the rotational driving axial line A. Also, the transmission member 210 stops rotating in the forward direction if the forward rotation restriction profile 245 of the cam profile 240 contacts with the forward rotation restriction projection 225. As the transmission member 210 progresses toward the assembling member 230, the driving assembling member 103 moves toward the driven assembling member 139 in the direction of the rotational driving axial line A to be thereby engage each other. Accordingly, if only a user opens and closes the side frame 105, the driving power for the developing unit can be blocked or supplied, thereby improving the user's convenience.

Figure 5A:
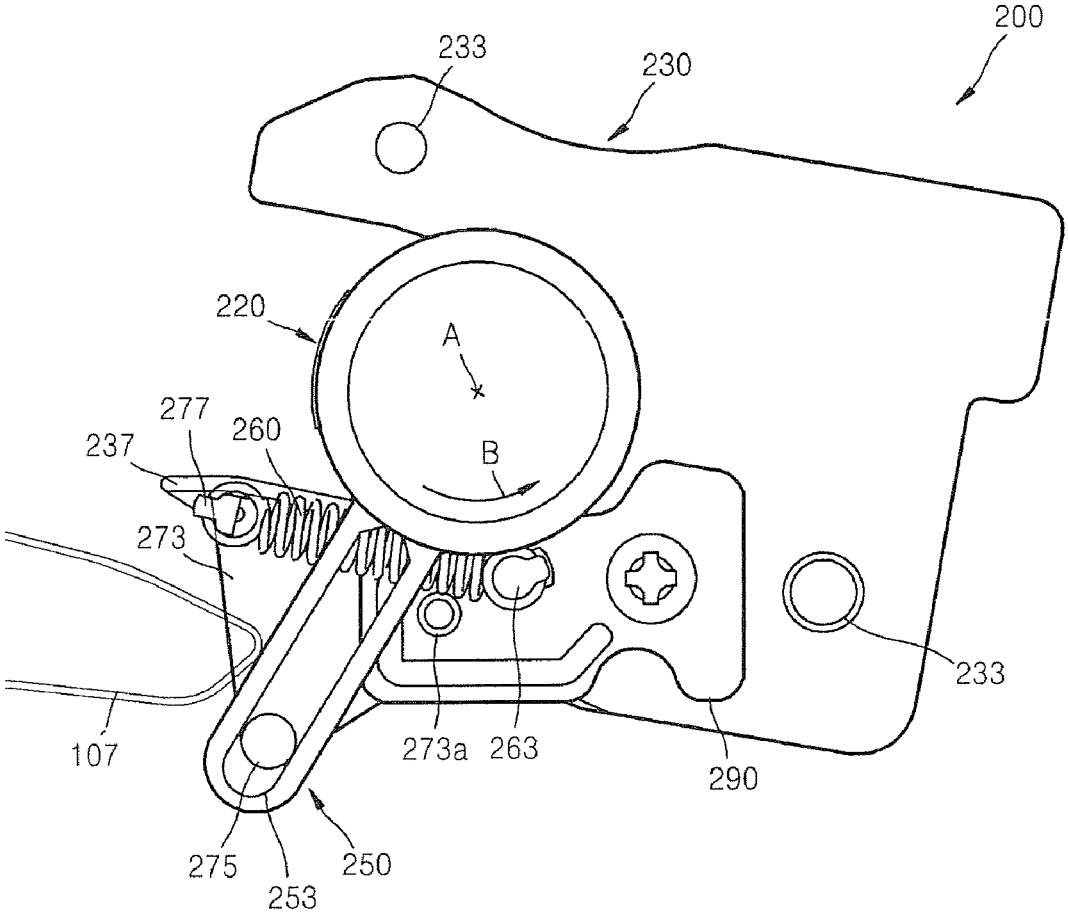
FIGS. 5A and 5B are front views of a main part illustrating an operating process of the power transmission unit in the image forming apparatus engaged with an actuator rotationally closed shown in FIG. 1.
Figure 5B:
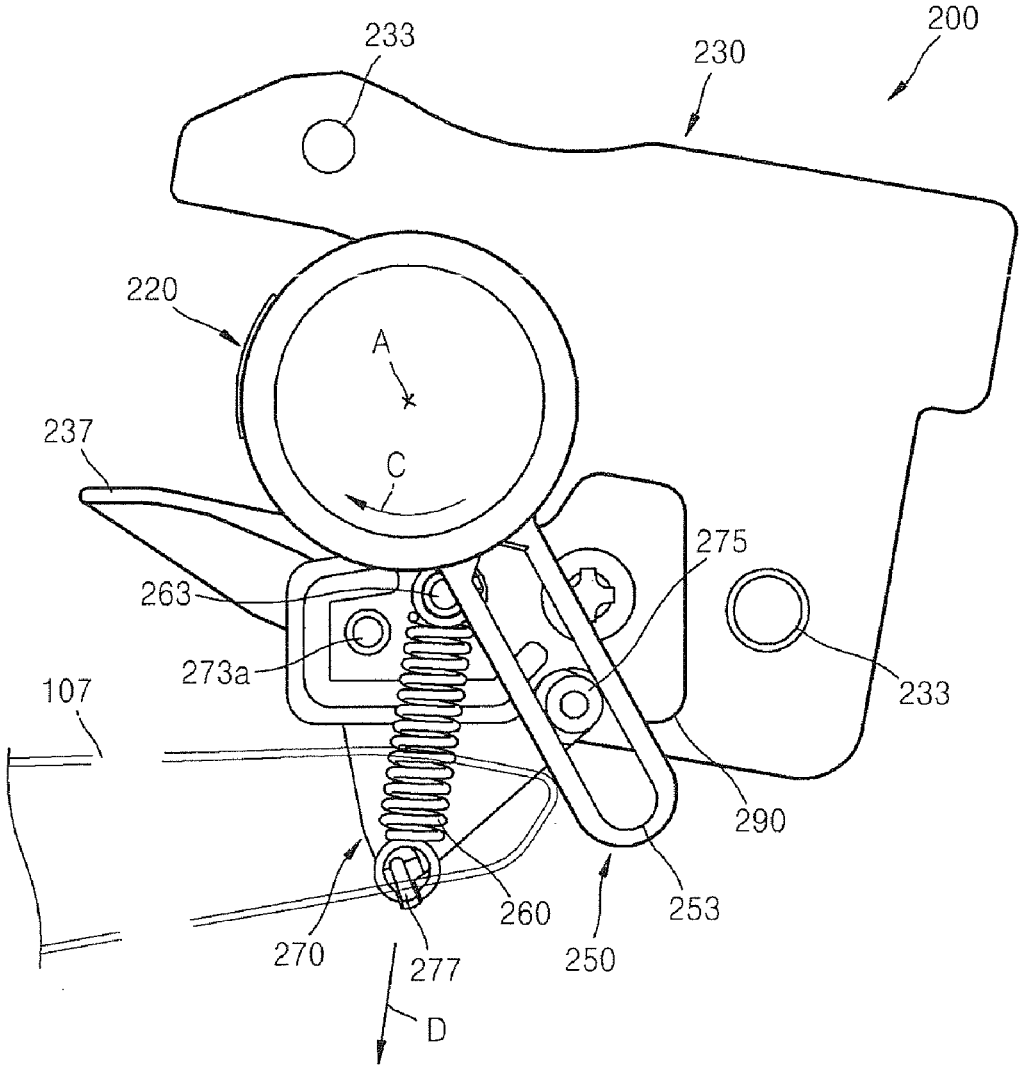

Furthermore, comparison of FIGS. 5A and 5B illustrates the design of the engaging rotational projection 275 and the hole 253 in the operating member 250. Before the actuator 107 engages the operating member 250, the engaging rotational projection 275 is disposed in a distal portion of the hole 253. As the actuator 107 applies pressure to the operating member 250, thereby causing the operating member 250 to move and the transmission member 210 to rotate in the forward direction B, the engaging rotational projection 275 moves along the length of the hole 253. Also, the biasing member 260 is extended and resists the rotation of the transmission member 210. Upon disengagement of the actuator 107, the biasing member 260 rotates the transmission member 210 in the reverse direction C, and the engaging rotational projection 275 moves along the hole 253 back to the distal portion of the hole 253.

Also, the manipulating unit and the power transmission unit can be engagedly-manipulated without assembling the two components by a member, such as a link. As such, the configuration is simplified and the power transmission unit can be activated by a small force applied to the manipulating unit.

Also, the simple configuration and the fewer components of the power transmission unit can lower a manufacture cost and improve productivity.

In addition, as long as the configurations of the driving assembling member 103 and the driven assembling member 139 are similar, one configuration of the power transmission unit can be applied to wherever the power transmission is needed, thereby enhancing compatibility and standardization of the components.

FIGS. 6, 7, and 8 illustrate the movement of the transmission member 210 toward and away from the assembling member 230 along the rotational driving axial line A; however, the engagement of the driving power is not limited thereto as one or both of the first and assembling members 210 and 230 may move along the rotational driving axial line A. With regard to FIG. 6, the first and assembling members 210 and 230 are separate from each other by the cam 220 and one end of the transmission member 210 despite the first and assembling members 210 and 230 being compressed toward each other by the biasing device 167. The biasing device 167 exerts pressure on the stationary frame 169 and the transmission member 210 in the direction of the rotational driving axial line A. As pressure is applied to the operating member 250 by the actuator 107 (not shown), the transmission member 210 rotates in the forward direction until the cam 220 and the cam profile 240 meet and engage.

FIG. 7 is a cross-section of FIG. 6 along the line VII and illustrates such when the cam 220 and the cam profile 240 (thereby the first and assembling members 210 and 230) are disengaged. As shown in FIG. 7, the transmission member 210 and a web 103*a* of the driving assembling member 103 contacts with one end of the transmission member 210 and are integrally-provided to move along a direction of the rotational driving axial line A. Since the driving assembling member 103 is elastically pressurized toward the driven assembling member 139 by the biasing device 167, the transmission member 210 is also elastically pressurized toward the driven assembling member 139. Further, as the first and assembling members 210 and 230 move together along the rotational driving axial line A, the driving assembling member 103 and the driving axle 168 move to engage the additional coupling 280. However, the driving assembling member 103 can move to directly engage the driven assembling member 139.

With reference to FIG. 8, the biasing device 167 is extended and the cam 220 and the cam profile 240 are completely engaged. As such, the driving axle 168, the driving assembling member 103, and the additional coupling 280 are also engaged. As the actuator 107 is removed, thereby removing pressure applied to the operating member 250, the transmission member 210 would rotate in the reverse direction C, and the cam 220 and the cam profile 240 would disengage. The transmission member 210, the driving assembling member 103, and the driving axle 168 would move along the rotational driving axial line A in the direction of the frame 169 to compress the biasing device 167 to disengage power from the driven assembling device 139.

Figure 9:
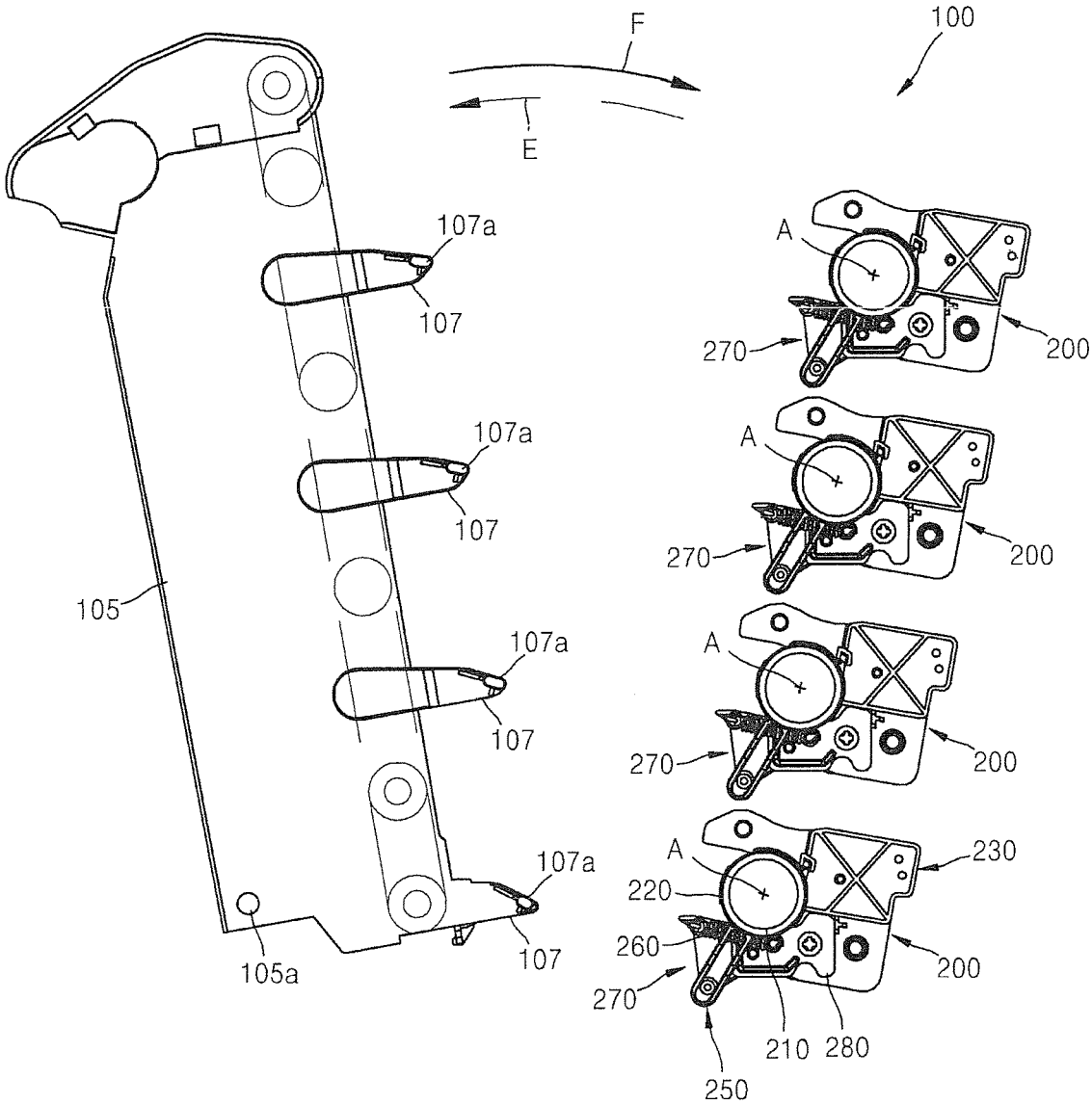
FIG. 9 is a side view of the main part illustrating an example embodiment of the image forming apparatus shown in FIG. 1.
Figure 10:
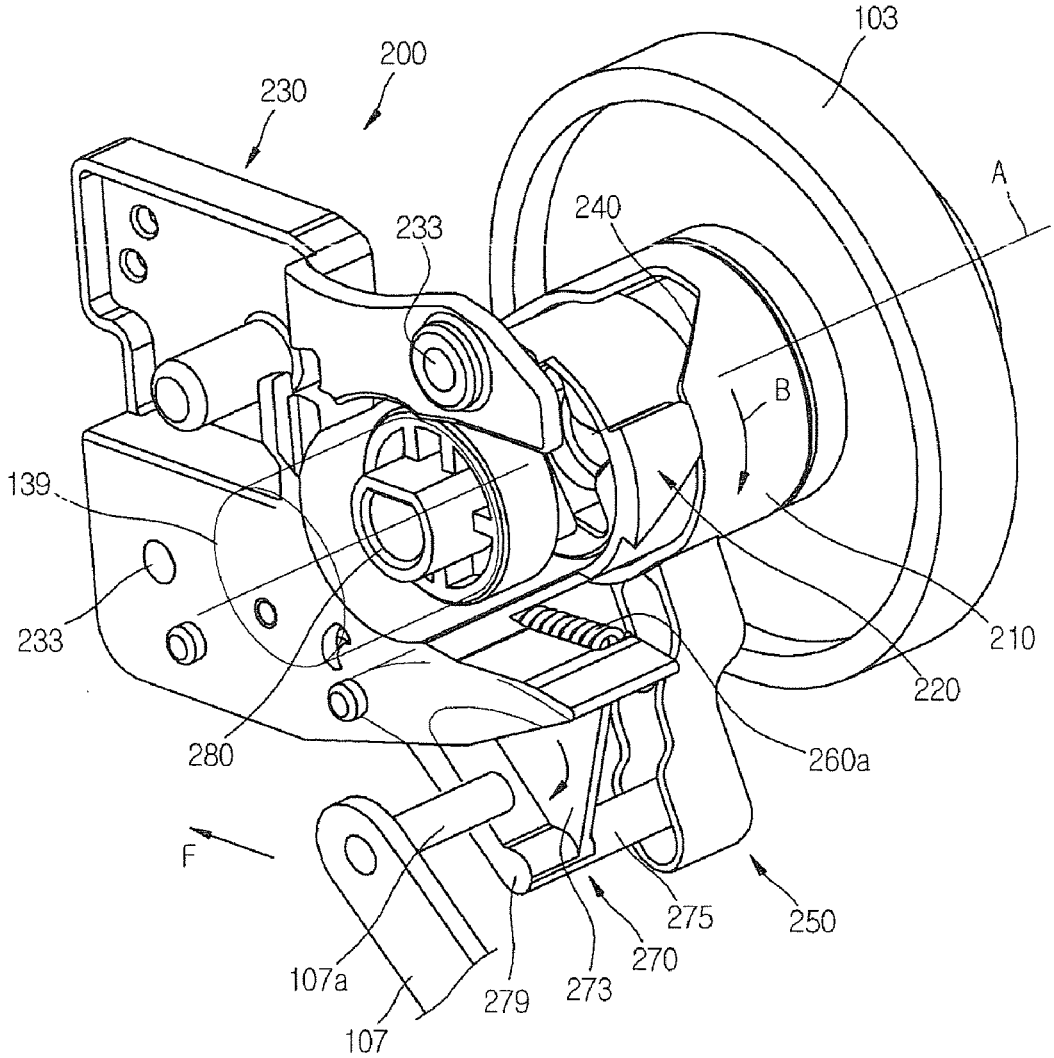
FIGS. 10 and 11 are rear perspective views illustrating an operating process of the power transmission unit according to the example embodiment shown in FIG. 9.
Figure 11:
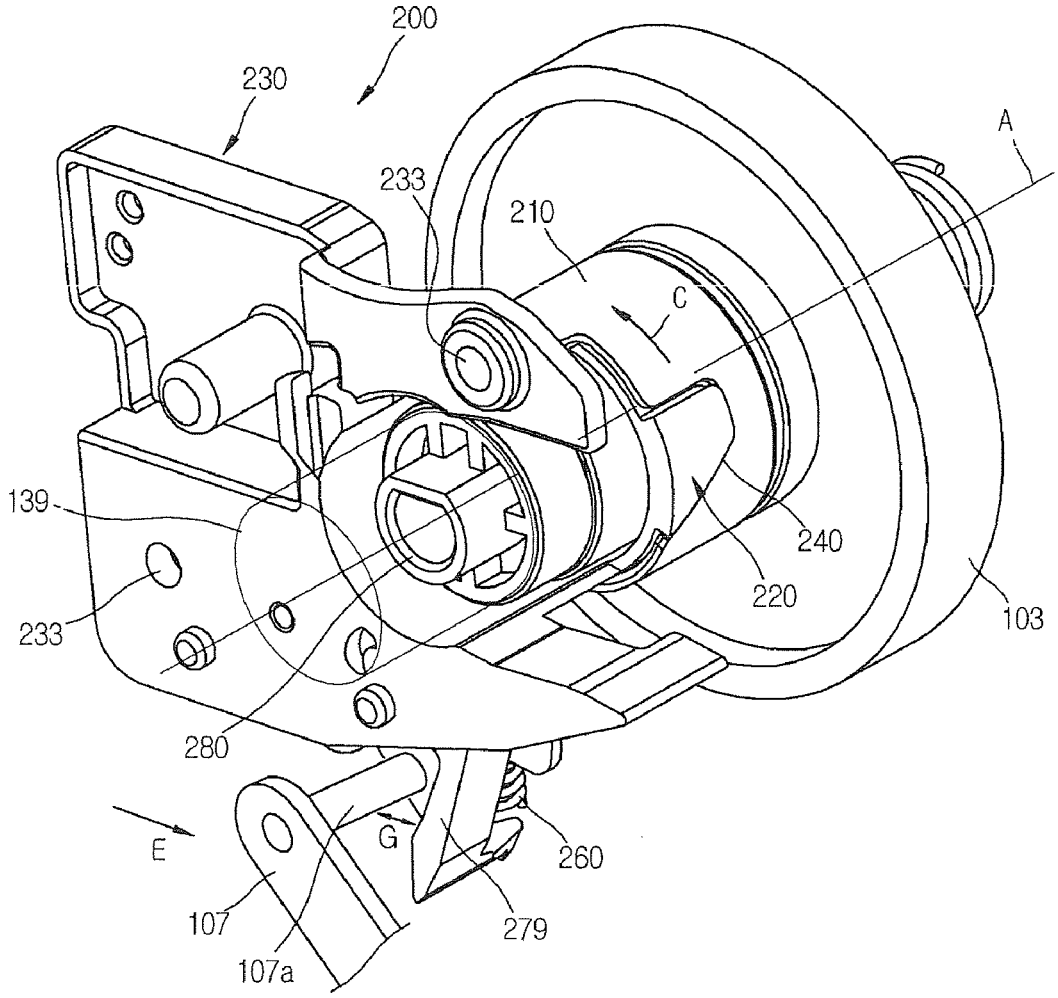

Meanwhile, so far it has been described that the transmission member 210 rotates in the forward and reverse directions B and C about the rotational driving axial line A as the actuator 107 applies pressure to and releases pressure from the operating member 250, but the actuator 107 may perform the same function by rotating the elastic pressure lever 270 in the forward and reverse directions as depicted in FIGS. 9, 10, and 11.

As shown in FIGS. 9, 10, and 11, the actuator 107 of the side frame 105 further includes a sub-projection 107*a* that extends along the rotational driving axial line A (the direction extending perpendicularly to the drawing in FIG. 9). Also, the elastic pressure lever 270 includes an operating member 279 formed in the plate 273 to open toward the driven assembling member 139 in consideration of the position of the sub-projection 107*a*. The operating member 279 is provided to be formed in a proper shape so as to accept the sub-projection 107*a* when the side frame 105 is rotationally closed and opened in directions F and E, respectively, even though the elastic pressure lever 270 rotates the operating member 279. Functioning of the operating member 279 is similar to the operation of the operating member 250 described above, and such operation achieves the same moving of the first and assembling apparatuses 210 and 230 along the rotational driving axial line A. As shown in FIG. 10, the operating member 279 may be provided in the shape of a < or a V such that the operating member 279 accepts the sub-projection 107*a* and rotates. In FIG. 10, the first and assembling apparatuses 210 and 230 are separated along the rotational driving axial line A and separated by the cam 220 and the cam profile 240. As the sub-projection 107*a* pressurizes the operating member 279 of the elastic pressure lever 270 as the side frame 105 is rotationally closed in the direction F, the transmission member 210 rotates in the forward direction B and approaches the assembling member 230 until the cam 220 and the cam profile 240 engage as shown in FIG. 11. As the actuator 107 and the sub-projection 107*a* move in the direction F, thereby rotating the operating member 279, the engaging rotation projection 275 of the elastic pressure lever 270 moves through the hole 253 of the operating member 250 to rotate the transmission member 210, thereby engaging the transmission member 210 and the assembling member 230. As the transmission member 210 slides in the rotational driving axial line A and engages the assembling member 230, the driving assembling member 103 engages the driven assembling member 139. As such, mechanical power is connected to the developing unit 130 shown in FIG. 1.

In FIG. 11, the sub-projection 107*a* and the operating member 279 are provided to be separated from each other by a predetermined interval G. Such configuration can be formed by properly changing the positions and the shapes of the hitching hook 277 and the fixing pin 263 so that the biasing device 260 can be maintained so that the biasing device 260 can rotate the transmission unit 210 back in the reverse direction when the cam profile 240 releases the cam 220. Contrastingly, as the sub-projection 107*a* applies pressure to the operating member 279 of the elastic pressure lever 270 as the side frame 105 is rotationally opened in the direction E, the cam profile 240 releases the cam 220 and the transmission member 210 rotates in the reverse direction C so as to separate from the assembling member 230 as in FIG. 10. As the side frame 105 is rotationally opened and closed in the directions E and F, the driven assembling member 139 and the driving assembling member 103 can be engaged and disengaged in the direction of the rotational driving axial line A.

Also, since the sub-projection 107*a* and the operating member 279 are separated by the predetermined interval G and the side frame 105 does not receive force or pressure from the biasing device 260 when the side frame 105 is disposed completely in the direction F, transfer of vibration from the developing unit 130 to the side frame 105 is decreased.

Figure 12:
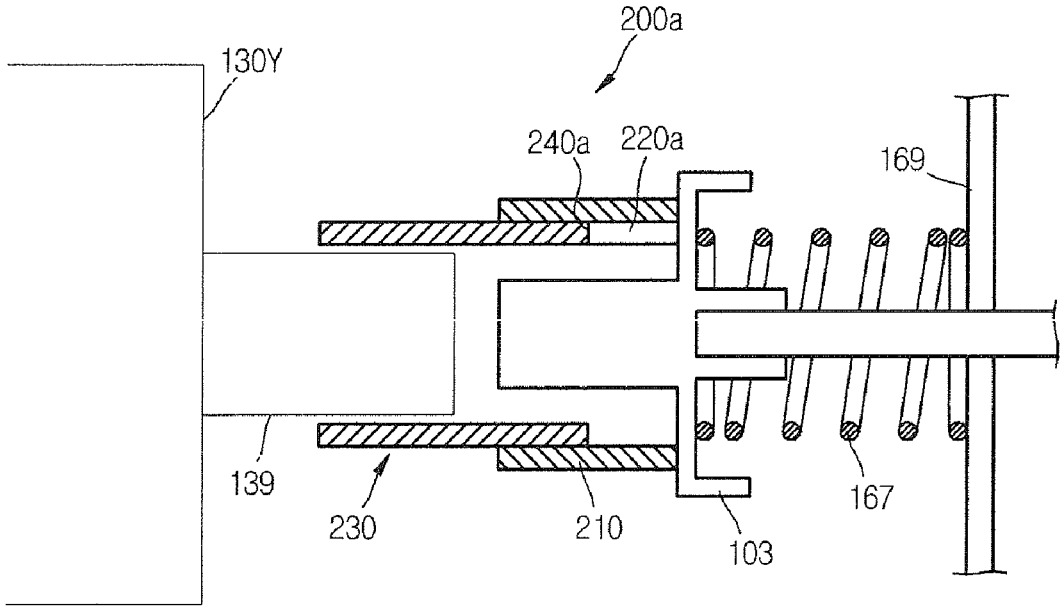
FIG. 12 is a schematic sectional view of a power transmission unit according to a second example embodiment of the present invention.

Referring to FIG. 12, in a power transmission unit 200*a* according to aspects of the present invention, a cam 220*a* is disposed on the inside surface of the transmission member 210, and the cam profile 240*a* is formed in the assembling member 230. Also, the cam 220*a* and the cam profile 240*a* perform the same function even though they are provided in opposite positions with regard to the above description.

Figure 13:
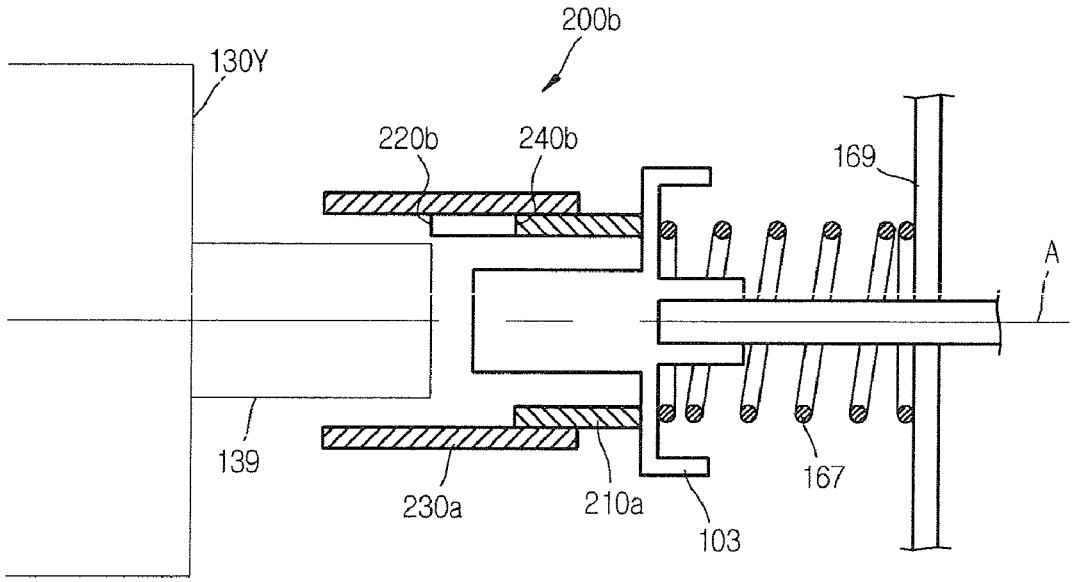
FIG. 13 is a schematic sectional view of the power transmission unit according to a third example embodiment of the present invention.

As shown in FIG. 13, a power transmission unit 200*b* according to further aspects of the current invention comprises a transmission member 210*a* and an assembling member 230*a*.

The transmission member 210*a* is provided to have an outside diameter smaller than the inside diameter of the assembling member 230*a*, and the outside surface is supported by the inside surface of the assembling member 230*a*. The transmission member 210*a* is provided to rotate by being supported by the assembling member 230*a*.

The cam 220*b* is provided on the inside surface of the assembling member 230*a*, and the cam profile 240*b* is provided in one end of the transmission member 210*a* that faces the cam 220*b*. Here, since the other components except for the shapes of the transmission member 210*a* and the assembling member 230*a*, and the positions of the cam 220*b* and the cam profile 240*b* are the same as in the above description and the operating process is the same, the description of the components will be omitted.

Figure 14A:
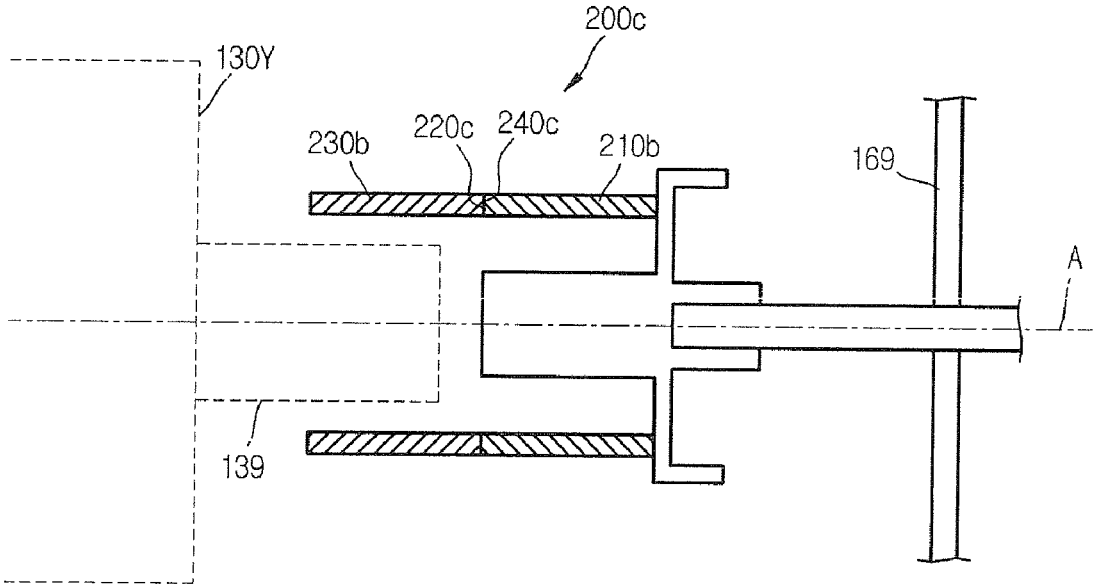
FIGS. 14A and 14B are a schematic sectional view and a side view of a power transmission unit according to a fourth example embodiment of the present invention.
Figure 14B:
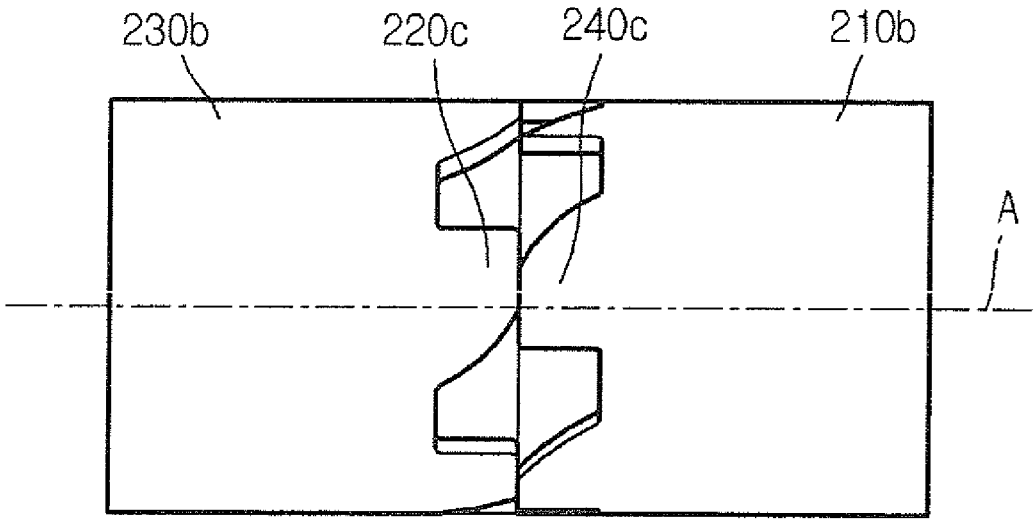

As shown in FIGS. 14A and 14B, a power transmission unit 200*c* according to further aspects of the present invention comprises a transmission member 210*b* and an assembling member 230*b*. The description of the other components will be omitted as they are the same as in the above descriptions.

The transmission member 210*b* and the assembling member 230*b* are provided in a cylindrical shape and concentric about a rotational driving axial line A. Also, the transmission member 210*b* and the assembling member 230*b* are provided such that the first and assembling members 210*b* and 230*b* contact at their facing leading edges. That is, the outside diameter of the transmission member 210*b* is provided larger than the inside diameter of the assembling member 230*b*, but the outside diameter of the transmission member 210*b* may be provided smaller than the outside diameter of the assembling member 210*b*. Also, the inside diameter of the transmission member 210*b* may be provided larger than the inside diameter of the assembling member 230*b*, but smaller than the outside diameter of the assembling member 230*b*. However, as shown in FIG. 14A, the transmission member 210*b* and the assembling member 230*b* may have the same inside and outside diameters so as to allow a smooth relative motion between the cam 220*c* and the cam profile 240*c*.

The cam 220*c* and the cam profile 240*c* are exclusively provided to the transmission member 210*b* and the assembling member 230*b* at their ends that face each other. As shown in FIG. 14B, the cam 220*c* and the cam profile 240*c* are provided in the shape projected from the facing side end parts along the rotational driving axial line A.

In the above descriptions of the aspects of the current invention, only the transmission members 210, 210*a*, 210*b*, and 210*c* have been described to rotate, but the assembling members 230, 230*a*, 230*b*, and 230*c* may be provided to rotate or the first and the assembling members may be both rotate.

As described above, the image forming apparatus and the power transmission unit according to aspects of the present invention have at least the following effects: First, a manipulating unit for manipulating the power transmission unit is provided in a member which is first opened and closed when mounting or detaching developing elements to interrupt the power of the developing unit. Accordingly, the rotational power need not be stopped separately, thereby improving convenience.

Second, even if a plurality of developing elements are mounted or detached, or there are a plurality of driven assembling members which receive the rotating power coaxially with one developing element, the power transmission unit according to aspects of the present invention can be applied having an advantage in compatibility and standardization of components, thereby lowering production cost and improving productivity.

Third, the power transfer to the developing elements can be interrupted by a small force that rotates the manipulating unit as the manipulating unit and the power transmission unit are not engaged.

Although a few embodiments of the present invention have been shown and described, it would be appreciated by those skilled in the art that changes may be made according to aspects of the above described invention without departing from the principles and spirit of the invention, the scope of which is defined in the claims and their equivalents.

What is claimed is:

1. An image forming apparatus, comprising:

a driving component to rotate a driving assembling member about a rotational driving axial line;

a developing unit detachably provided in the image forming apparatus that has a driven assembling member capable of being engaged with and disengaged from the driving assembling member in a direction of the rotational driving axial line;

a power transmission unit to selectively engage a mechanical power to the developing unit; and a manipulating unit to manipulate the power transmission unit, wherein the power transmission unit is disposed between the driving assembling member and the driven assembling member and enables at least one of the driving assembling member and the driven assembling member to move in the direction of the rotational driving axial line, and the driven assembling member is rotated about the rotational driving axial line by the driving component when the driven assembling member and the driving assembling member are engaged, wherein at least one of the driving assembling member and the driven assembling member is elastically pressurized toward the other of the driven assembling member and the driving assembling member.

2. An image forming apparatus, comprising:

a driving component to rotate a driving assembling member about a rotational driving axial line;

a developing unit detachably provided in the image forming apparatus that has a driven assembling member capable of being engaged with and disengaged from the driving assembling member in a direction of the rotational driving axial line;

a power transmission unit to selectively engage a mechanical power to the developing unit; and a manipulating unit to manipulate the power transmission unit, wherein the power transmission unit is disposed between the driving assembling member and the driven assembling member and enables at least one of the driving assembling member and the driven assembling member to move in the direction of the rotational driving axial line, and the driven assembling member is rotated about the rotational driving axial line by the driving component when the driven assembling member and the driving assembling member are engaged, wherein at least one of the driving assembling member and the driven assembling member rotates in a forward direction about the rotational driving axial line and a reverse direction about the rotational driving axial line and is moveable in the direction of the rotational driving axial line.

3. The image forming apparatus of claim 2, wherein the power transmission unit comprises:

a transmission member rotatable in the forward direction and the reverse direction and moveable in the direction of the rotational driving axial line to enable one of the driving assembling member and the driven assembling member to move toward the other of the driving assembling member and the driven assembling member in the direction of the rotational driving axial line; and an assembling member disposed in the other of the driving assembling member and the driven assembling member.

4. The image forming apparatus of claim 3, wherein the manipulating unit selectively rotates the transmission member in the forward direction to engage the driving assembling member and the driven assembling member.

5. The image forming apparatus of claim 4, further comprising:

a cam disposed in at least one of the transmission member and the assembling member; and a cam profile disposed in the other one of the transmission member and the assembling member, wherein the cam profile guides the movement of the cam.

6. The image forming apparatus of claim 5, wherein the transmission member and the assembling member each have a cylindrical shape.

7. The image forming apparatus of claim 6, wherein an inside surface of the transmission member is supported by an outside surface of the assembling member.

8. The image forming apparatus of claim 7, wherein the cam extends from at least one of the inside surface of the transmission member and the outside surface of the assembling member, and the cam profile prevents a relative rotation of the cam by contacting the cam to exert a force transverse to the direction of the rotational driving axial line.

9. The image forming apparatus of claim 6, wherein an inside diameter of the transmission member is larger than an inside diameter of the assembling member, and the inside diameter of the transmission member is smaller than an outside diameter of the assembling member.

10. The image forming apparatus of claim 9, wherein the cam is disposed in at least one of a facing end of the transmission member and a facing end of the assembling member; and the cam profile is disposed in the other of the facing end of the transmission member and the facing end of the assembling member.

11. The image forming apparatus of claim 6, wherein the outside surface of the transmission member is supported by the inside surface of the assembling member.

12. The image forming apparatus of claim 11, wherein the cam extends from at least one of the outside surface of the transmission member and the inside surface of the assembling member, and the cam profile prevents a relative rotation of the cam by contacting the cam to exert a force transverse to the direction of the rotational driving axial line.

13. The image forming apparatus of claim 4, wherein the power transmission unit further comprises:

an operating member to receive a rotational force from the manipulating unit to rotate the transmission member in the forward direction; and a biasing device to apply a biasing force to rotate the transmission member in the reverse direction if the rotational force is less than the biasing force.

14. The image forming apparatus of claim 13, wherein the power transmission unit further comprises:

a fixing pin with which one end of the biasing device is coupled to the assembly member; and a pressure lever coupled to an other end of the biasing device, wherein the biasing device elastically pressurizes the pressure lever to rotate the transmission member in the reverse direction.

15. The image forming apparatus of claim 14, wherein the pressure lever comprises:

a plate disposed in a transverse direction with respect to the rotational driving axial line; and an engagement rotational projection projected from the plate toward the operating member, and the operating member comprises:

a hole into which the engagement rotational projection is inserted, wherein the pressure lever accepts the rotational force from the manipulating unit and transfers the rotational force to the operating member via the engagement rotational projection to rotate the transmission member in the forward direction.

16. The image forming apparatus of claim 15, wherein the manipulating unit comprises an actuator to apply the rotational force to the pressure lever, and the actuator and the pressure lever do not contact when the transmission member is fully rotated in the forward direction.

17. The image forming apparatus of claim 1, wherein the manipulating unit comprises an actuator which applies a rotational force to the power transmission unit.

18. A power transmission unit for an image forming apparatus, comprising:

a driving component to rotate a driving assembling member about a rotational driving axial line;

a driven assembling member which is capable of being engaged with and disengaged from the driving assembling member in the direction of the rotational driving axial line;

a transmission member to selective allow or prohibit at least one of the driving assembling member and the driven assembling member to move in the direction of the rotational driving axial line; and an assembling member which rotates relative to the transmission member, an operating member to receive a rotational force to rotate the transmission member in the forward direction; and a biasing device to apply a biasing force to rotate the transmission member in the reverse direction if the rotational force is less than the biasing force.

19. A power transmission unit for an image forming apparatus, comprising:

a driving component to rotate a driving assembling member about a rotational driving axial line;

a driven assembling member which is capable of being engaged with and disengaged from the driving assembling member in the direction of the rotational driving axial line;

a transmission member to selective allow or prohibit at least one of the driving assembling member and the driven assembling member to move in the direction of the rotational driving axial line; and an assembling member which rotates relative to the transmission member, wherein a cam is disposed in at least one of the transmission member and the assembling member, and a cam profile to guide the movement of the cam is disposed in the other of the at least one of the transmission member and the assembling member.

20. The power transmission unit of claim 19, wherein the cam comprises a sliding projection that extends in a direction to cross the direction of the rotational driving axial line so that the transmission member is slidable toward the assembling member when the transmission member rotates in a forward direction.

21. The power transmission unit of claim 19, wherein the cam comprises a movement restriction projection that extends in a transverse direction with respect to the direction of the rotational driving axial line to restrict the transmission member from moving toward the assembling member in the direction of the rotational driving axial line.

22. The power transmission unit of claim 19, wherein the cam profile comprises:

a first movement restriction profile that extends in a transverse direction with respect to the direction of the rotational driving axial line, wherein the movement restriction projection and the first movement restriction profile slidably contact to restrict the transmission member from moving toward the assembling member in the direction of the rotational driving axial line when the transmission member is not rotated in the forward direction.

23. The power transmission unit of claim 22, wherein the cam profile further comprises:

a second movement restriction profile that extends in a transverse direction with respect to the direction of the rotational driving axial line, wherein the movement restriction projection and the second movement restriction profile contact to restrict the transmission member from moving toward the assembling member in the direction of the rotational driving axial line when the transmission member is fully rotated in the forward direction.

24. The power transmission unit of claim 19, wherein the cam comprises a forward rotation restriction projection that extends in the direction of the rotational driving axial line so as to restrict a forward rotation of the transmission member.

25. An image forming apparatus, comprising:

a driving component to rotate a driving assembling member;

a developing component to be rotated about a rotational driving axial line by a driven assembling member engageable with the driving assembling member in a direction of the rotational driving axial line;

a power transmission unit comprising:

a transmission member comprising one of a cam and a cam profile; and an assembling member comprising the other of the cam profile and the cam profile, wherein the transmission unit and the assembling apparatus are disposed between the driving assembling member and the driven assembling member and at least one of the transmission member and the assembling member rotates in a forward direction and a reverse direction and at least one of the transmission member and the assembling member is moveable in the direction of the rotational driving axial line;

a main body comprising a manipulating unit to manipulate the power transmission unit.

* * * * *

UNITED STATES PATENT AND TRADEMARK OFFICE

CERTIFICATE OF CORRECTION

PATENT NO. : 7,835,666 B2
APPLICATION NO. : 11/944544
DATED : November 16, 2010
INVENTOR(S) : Se-min Kim et al.

It is certified that error appears in the above-identified patent and that said Letters Patent is hereby corrected as shown below:

Column 18, Line 26-45 (Approx.) In Claim 18, delete "18. A power transmission unit for an image forming apparatus, comprising:
a driving component to rotate a driving assembling member about a rotational driving axial line;
a driving assembling member which is capable of being engaged with and disengaged from the driving assembling member in the direction of the rotational driving axial line;
a transmission member to selective allow or prohibit at least one of the driving assembling member in the direction of the rotational driving axial line; and
an assembling member which rotates relative to the transmission member, an operating member to receive a rotational force to rotate the transmission member in the forward direction; and
a biasing device to apply a biasing force to rotate the transmission member in the reverse direction if the rotational force is less than the biasing force."

and insert --18. A power transmission unit for an image forming apparatus, comprising:
a driving component to rotate a driving assembling member about a rotational driving axial line;
a driving assembling member which is capable of being engaged with and disengaged from the driving assembling member in the direction of the rotational driving axial line;
a transmission member to selective allow or prohibit at least one of the driving assembling member in the direction of the rotational driving axial line; and
an assembling member which rotates relative to the transmission member,
an operating member to receive a rotational force to rotate the transmission member in the forward direction; and
a biasing device to apply a biasing force to rotate the transmission member in the reverse direction if the rotational force is less than the biasing force.--, therefor.

Column 19, Line 11, In Claim 22, delete "19," and insert --21,--, therefor.

Signed and Sealed this
Twenty-sixth Day of April, 2011

David J. Kappos

David J. Kappos
*Director of the United States Patent and Trademark Office*